US006986916B2

(12) United States Patent
Hamamoto et al.

(10) Patent No.: US 6,986,916 B2
(45) Date of Patent: Jan. 17, 2006

(54) COATING APPARATUS AND METHOD FOR APPLYING COATING SOLUTION ON WEB

(75) Inventors: Nobuo Hamamoto, Kanagawa (JP); Hideaki Usui, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 32 days.

(21) Appl. No.: 10/347,614

(22) Filed: Jan. 22, 2003

(65) Prior Publication Data

US 2003/0180465 A1 Sep. 25, 2003

(30) Foreign Application Priority Data

Jan. 24, 2002 (JP) ..... 2002-016017

(51) Int. Cl.
*B05D 1/26* (2006.01)

(52) U.S. Cl. ..... 427/314; 427/8; 427/402; 427/420; 118/410

(58) Field of Classification Search ..... 427/402, 427/420, 314; 118/410, 411
See application file for complete search history.

(56) References Cited

U.S. PATENT DOCUMENTS 5,332,440 A * 7/1994 Hirshburg ..... 118/411
5,837,324 A 11/1998 Yapel et al.

FOREIGN PATENT DOCUMENTS

| | | |
|---|---|---|
| DE | 3037612 | 5/1982 |
| EP | 1061412 | 12/2000 |
| JP | 55-84577 | 6/1980 |
| JP | 59203666 | 11/1984 |
| JP | 61057260 | 3/1986 |
| JP | 3-71185 | 11/1991 |
| JP | 10-128212 | 5/1998 |
| JP | 10-151397 | 6/1998 |
| JP | 10-165870 | * 6/1998 |
| JP | 10-165872 | 6/1998 |
| WO | WO 94/08272 | 4/1994 |

* cited by examiner

*Primary Examiner*—Katherine Bareford
(74) *Attorney, Agent, or Firm*—Young & Thompson

(57) ABSTRACT

In a coating apparatus of slide bead type for applying a coating solution on a continuously-fed web, each of edge members has a edge member for regulating a width of coating solution flowing on a slide surface. A height Dg of a perpendicular wall of the edge member satisfies a condition Db≦Dg≦Ds, when Db is determined as a minimum thickness of bead formed by a coating solution, and Ds is determined as an upper limit of the upper limit of the height Dg. A distance between a web and a front end portion of the edge member is more than 100 μm.

8 Claims, 16 Drawing Sheets

COATING APPARATUS AND METHOD FOR APPLYING COATING SOLUTION ON WEB

BACKGROUND OF THE INVENTION

1. Field of the Invention

The present invention relates to an apparatus and a method thereof for applying a coating solution on a continuous base (hereinafter web) with a solution in slide bead method for producing photographic film, photographic paper, photosensitive printing material, medical photosensitive material, micro film, magnetic recording tape, adhesive tape, pressure sensitive recording paper, thermosensitive recording paper, off-set printing material, film for liquid crystal display, and the like.

2. Description Related to the Prior Art

In a coating apparatus for applying a coating solution on a web in a slide bead method, a method for regulating a form of edges of the coating solution are disclosed in Japanese Patent Laid-Open Publications No. 55-84577, 10-128212, 10-151397, 10-165870, and 10-165872. In the method disclosed in the publications, a thickness of a coating layer at the edge is regularized by forming the best shape of an edge plate for regularizing a width of the solution on a slide surface, by blowing an air blow to the edge, and inserting a slot to the edges and the like.

However, the above mentioned coating apparatus has complex structure for which fine adjustments are necessary. When the coating apparatus is renewed, a difference of accuracy between the coating apparatuses causes to prevent from being in the best condition.

A method for solving the problem is disclosed in Japanese Patent No. 3-71185 and Japanese Patent Laid-Open Publication 7-502685. However, the coating apparatus described in the former publication often causes a defect of the edges of bead. Further an operation of the coating apparatus described in the latter publication is not so easy as to make a positional adjustment of an edge plate with a hopper edge guide device, and the determination of position of the edge plate is hard.

Further as shown in FIG. 21, when a height Dg of a side perpendicular wall 101 of an edge plate 100 is made to be less than the minimum thickness Db of bead of a coating solution, a flow of the solution 117 cannot be regulated only by the side perpendicular wall 101 at a minimum thickness position Dr of bead. Accordingly, a vena contracta is generated at the minimum thickness position Dr of the bead, the thickness at the edges of the coating solution becomes large, which causes the defect in drying.

SUMMARY OF THE INVENTION

An object of the present invention is to provide a coating apparatus having a simple structure for which adjustments are easily carried out.

Another object of the present invention is to provide a coating apparatus with which a difference in a distribution of applying a coating solution on a web is not so large that a defect in drying may not occur.

Still another object of the present invention is to provide a method of applying a coating solution on a continuously feeding web with a coating apparatus, in which adjustments of the coating apparatus are easily carried out.

Still another object of the present invention is to provide a method of applying a coating solution on a continuously feeding web with a coating apparatus, in which a difference in a distribution of applying a coating solution on the web is not so large that a defect in drying may not occur. When Db is a minimum thickness of bead at vena contracta and Ds is an upper limit of a height of said regulation portion, then Db and Ds are represented as follows, $$Db(m)=1.03\times h1-1.50\times he\times U^{-1/3}+12800\times he^2\times U$$

$$Ds(m)=\{3\times\eta\times q/(\rho\times g\times\sin\alpha)\}^{1/3}$$

Herein, h1 is a distance between said web and a lip of said die, whose unit is "m";

he is a thickness of said coating layer formed on said web, whose unit is "m";

U is a feeding velocity of said web, whose unit is "m/s";

η is an averaged viscosity of solution flowing on said slide surface at a share rate, whose unit is "m·Pa·s";

q is a total amount of said coating solution in a predetermined width, whose unit is "$m^3$/(m·sec)";

ρ is an averaged density of said solution, whose unit is "kg/$m^3$";

g is an acceleration of gravity, and

α is an angle of slide surface.

Further, a height of the regulate portion Dg may satisfy a condition 0.15 mm≦Dg≦5 mm. On the uppermost of the regulate portion is formed a side inclination portion which is inclined to the slide surface.

Otherwise, the edge member has a front end portion provided so as to be parallel to a tangent line at a lowest position of applying the coating solution on the web. A height of the end portion is lower than 0.6 mm. Further on the uppermost of the front end portion is formed a front inclination portion which is inclined to the slide surface.

In a method for coating a coating solution, a coating solution is applied on a web with a coating apparatus of slide bead type that has an edge member provided for regulating a width of the coating solution flowing on a slide surface. The regulate portion is provided to be perpendicular to the slide surface, and an edge of the regulate portion contacts to the slide surface. A height Dg of the regulate portion satisfies a condition Db≦Dg≦Ds, in which Db and Ds is represented as follows:

$$Db(m)=1.03\times h1-1.50\times he\times U^{-1/3}+12800\times he^2\times U$$

$$Ds(m)=\{3\times\eta\times q/(\rho\times g\times\sin\alpha)\}^{1/3}.$$

Herein, h1 is a distance between said web and a lip of said die, he is a thickness of said coating layer formed on said web, U is a feeding velocity of said web, η is an averaged viscosity of solution flowing on said slide surface at a share rate, q is a total amount of said coating solution in a predetermined width, ρ is an averaged density of said solution, g is an acceleration of gravity, and α is an angle of slide surface.

Further, a height of the regulation portion Dg may satisfy a condition 0.15 mm≦Dg≦5 mm.

Otherwise, the edge plate includes an end portion provided so as to be parallel to a tangent line at a lowest position of applying the coating solution on the web. A height of the end portion is lower than 0.6 mm.

The edge member may be constructed of a plate body and an end block attached to the plate body. In this case, it is preferable that the end block is fixed to the plate body with screws.

According to the invention, as the edge member of the coating apparatus is formed so as to satisfy the above conditions, the adjustments of the coating apparatus is easily made, and the difference in a distribution of applying a coating solution on a web is not large that a defect in drying may not occur.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
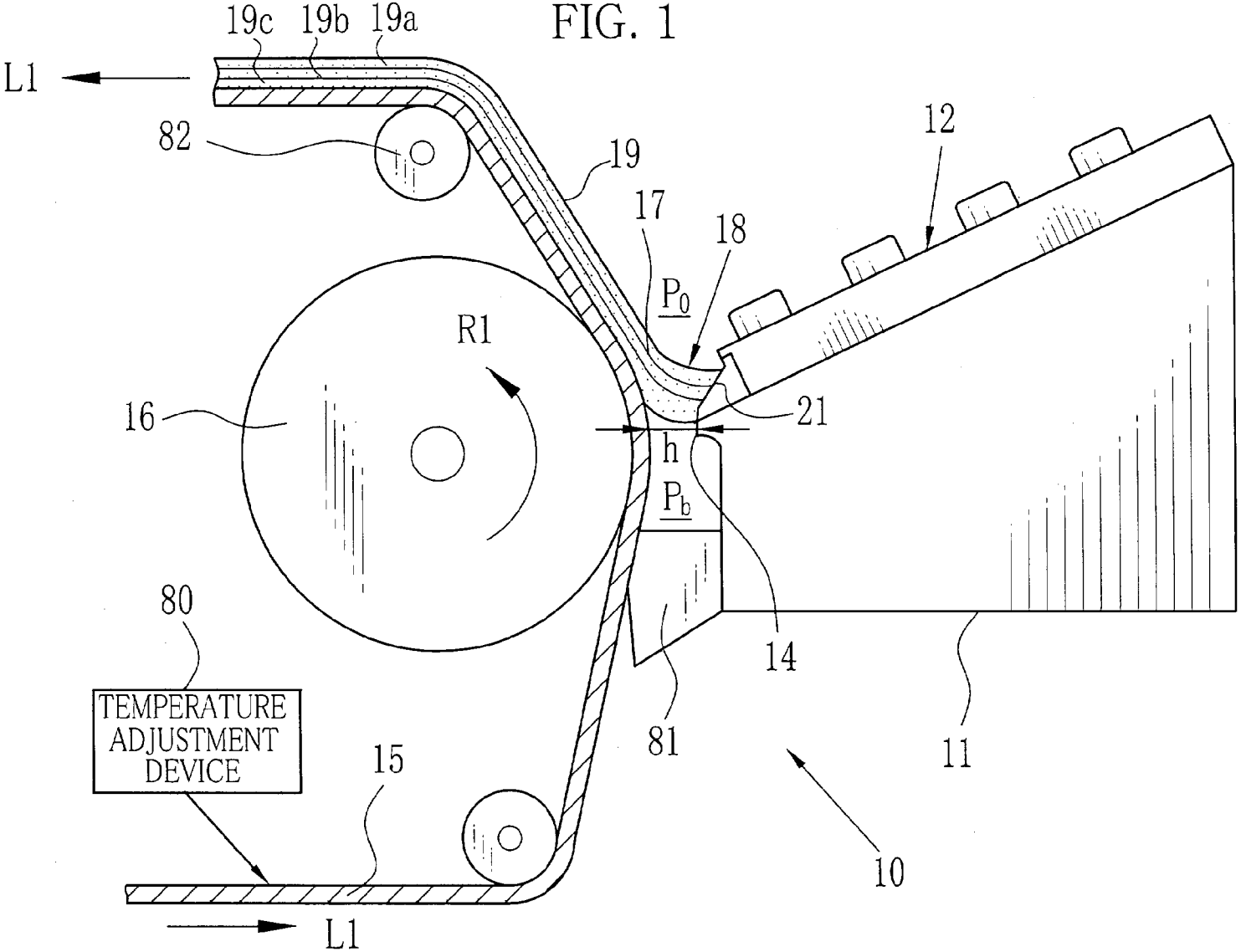
FIG. 1 is a side view of a coating apparatus in a situation of forming a coating layer of a coating solution on a web.

As shown in FIG. 1, a coating apparatus 10 includes a die 11, an edge plate 12 having a front inclination 21, and a back-up roller 16 for supporting a web 15. When the back-up roller 16 rotates in a direction R1, the web 15 is fed in a feeding direction L1. A coating solution 17 having three solution elements (see, FIG. 17) flows out from the lip 14 formed on an end of the die 11. Then the coating solution 17 forms a bead 18 to reach the web 15, and is dried in natural seasoning on the web 15 to form a coating layer 19 constructed with lowest, middle and uppermost sub-layers 19*a*, 19*b*, 19*c* on the web 15.

Note that the temperature of the web 15 is adjusted by a temperature adjustment device 80 before applied with the coating solution 17, such that the temperature may be 30–40° C. when receiving the coating solution 17.

The feeding velocity U of the web 15 is between 1–6 m/s, preferably. Further the die 11 includes a vacuum chamber 81 for sucking or aspirating an air below the bead 18, such that the pressure Pb below the bead 18 becomes smaller than the normal pressure P0 above the bead 18. Note that a difference P0–Pb is preferable to be between 300 and 1000 Pa, particularly between 400 and 700 Pa.

The web 15 coated with the coating layer 19 is fed to a drying section (not shown) by a feed roller 82. In the drying section, the solvent in the coating layer 19 evaporates and dries to form a product.

[Web]

The web 15 is for example, a paper, a plastic film, a resin coated paper, a synthesized paper and the like. However the web is not restricted in them. Materials of the plastic film are for example polyolefine (polyethylene, polypropyrene, and the like), and vinyl polymer (vinyl acetate, polyvinylchloride, polystyrene and the like). Further, there are polyamide (nylon-66, nylon-6 and the like), polyester (polyethylene terephthalate, polyethylene-2,6-naphthalate, and the like), polycarbonate, and cellulose acetate (cellulosetriacetate (hereinafter TAC), cellulose diacetate and the like). Preferably, under-layer of gelatin and the like is formed on a surface of the web 15. In this case the coating solution is smoothly and effectively applied on the web 15. As a resin for the resin coated paper, the polyolefine, such as polyolefine is usually used. However, it is not restricted.

[Coating Solution]

There are a lot of types of the coating solution used for the present invention. For example, in producing a photosensitive material, the coating solution is used for forming a photosensitive emulsion layer, a under layer, a protective layer, a back layer and the like. Further the coating solution may be used, which forms the adhesive layer, coloring layer, anticorrosion layer, and the like. It is preferable the coating solution contains a water soluble binder or an organic binder. Particularly, the main component of the coating solution is gelatin, latex, polyvinylalchohol, styrene butadiene rubber, and the like, and especially gelatin. However, the coating solution of the present invention is not restricted in it.

[Coating Apparatus]

Figure 2:
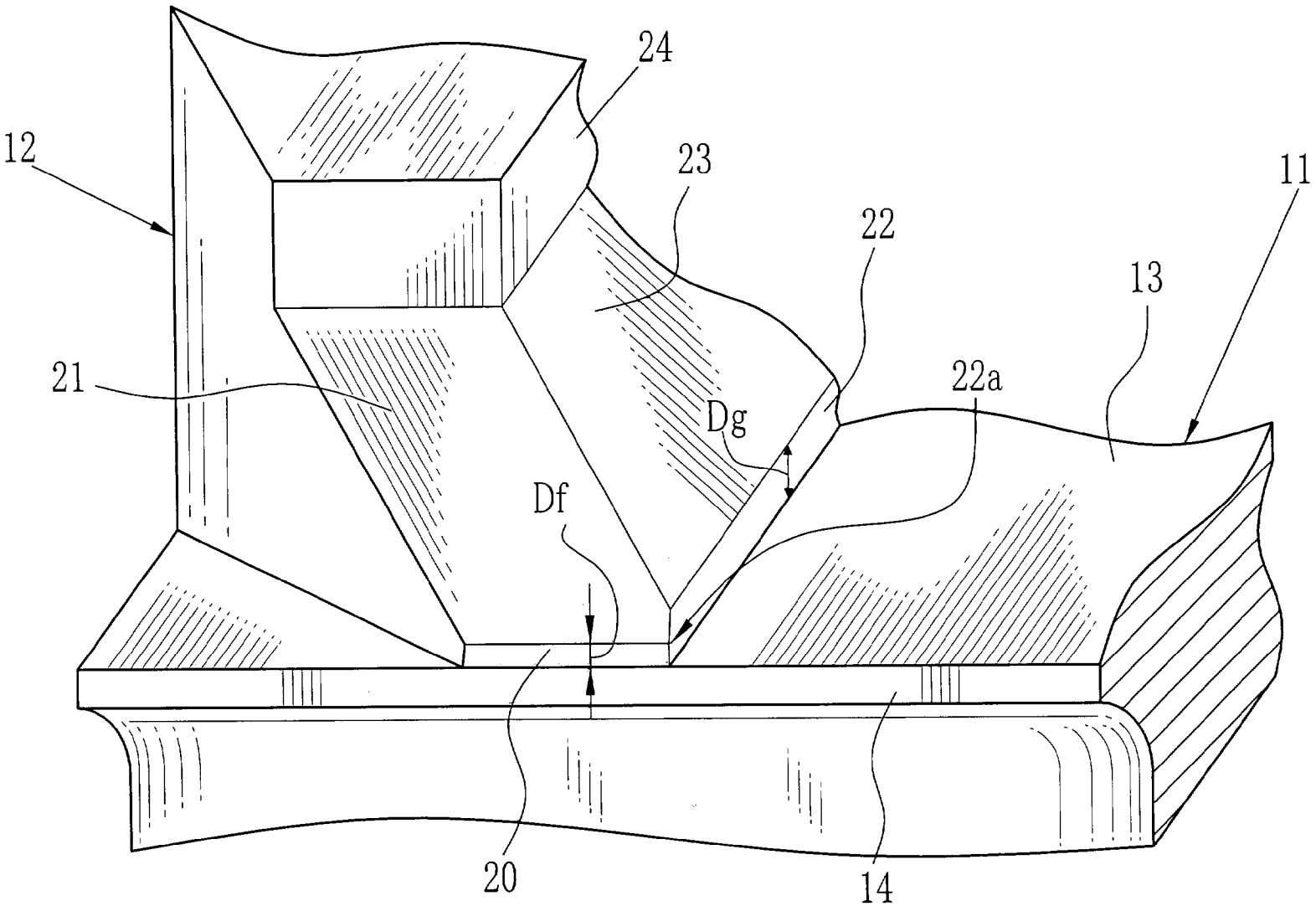
FIG. 2 is an enlarged perspective view of an edge plate of the coating apparatus.
Figure 3:
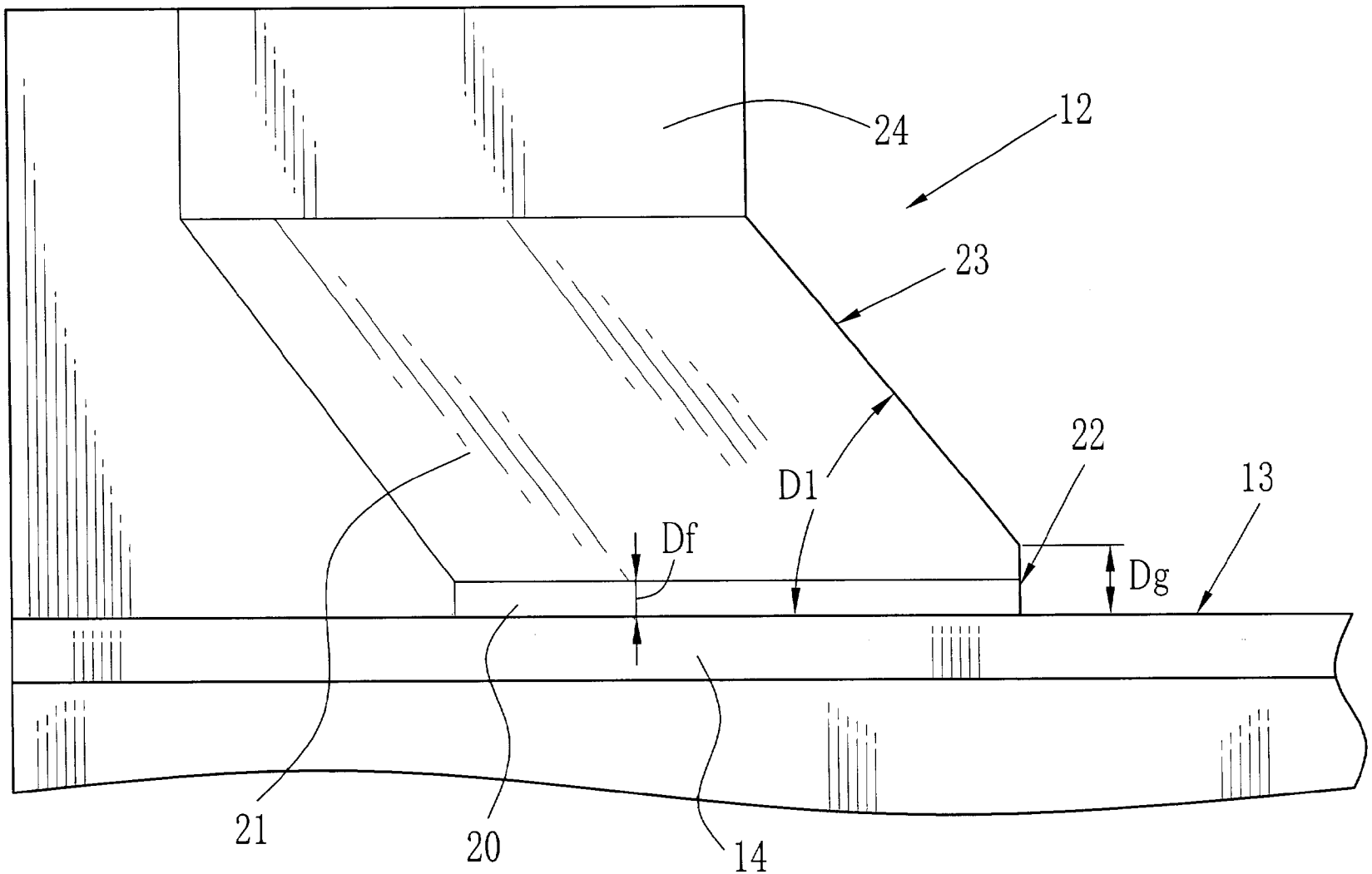
FIG. 3 is a plan view of the edge plate in FIG. 2.

In FIG. 2, the edge plate 12 is provided on a slide face 13 of the die 11 such that an end face 20 having a height Dg and the lip 14 of the die 11 form the same face. The edge plate 12 has a perpendicular wall 22 having a height Dg, an inclined wall 23 and an upper wall 24. The edge plate 12 is provided also in another edge of the die 11, whose illustration is omitted. The coating solution 17 flows in a space formed by the slide surface 13, the perpendicular wall 22 and the inclined wall 23. The upper wall 24 prevents the coating solution 17 from overflowing. Note that the form of the end portion 22*a* of the perpendicular wall 22 may have a complex form. Accordingly, the form of the end portion is not restricted in that of the figure. Further, as shown in FIG. 3, an angular between the inclined wall 23 and the slide surface 13 is set in range of 45–75°.

Figure 4:
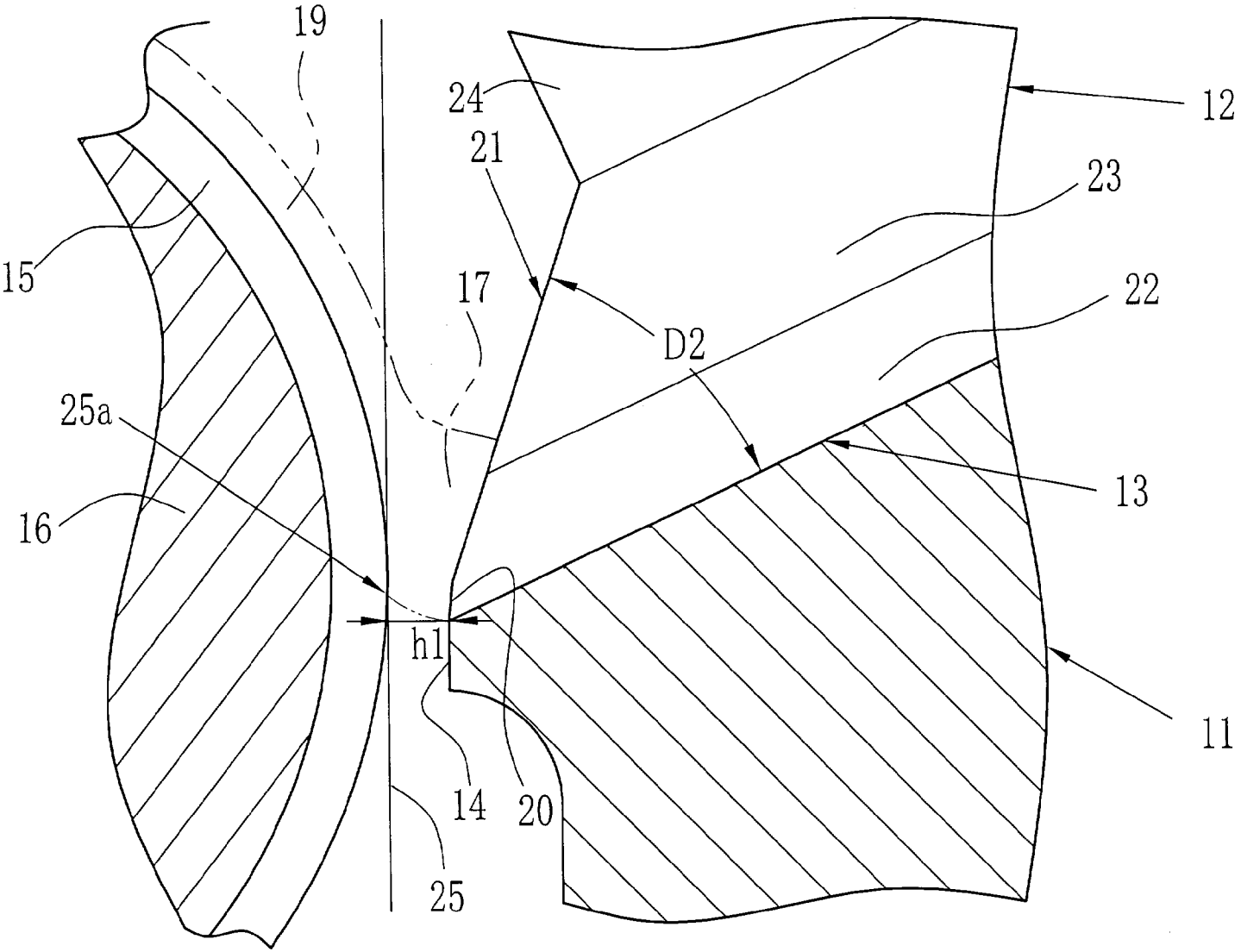
FIG. 4 is a sectional view of the coating apparatus, which illustrates a positional relation to the web and a back-up roller for feeding the web.

In FIG. 4, it is preferable that a distance h1 between the lip 11 and the web 15 set in a 200–300 μm, as the coating solution 17 is applied so as to have a constant thickness on the web 15. It is especially preferable that the end face 20 is formed to be parallel to a tangent line 25 drawn at a lowest position (hereinafter contact position) 25*a* where the coating solution 17 contacts to the web 15. However the angle of the tangent line 25 to the end face 20 may be charged between −30° and +30°. An angle D2 between the front inclination 21 and the slide surface 13 is set to 35–60°. Thus the applying of the coating solution 17 is made adequately. Note that the FIG. 4 illustrates a situation in which the coating solution 17 is not applied. However, the position of the coating solution 17 is shown by the chain double-dashed line for easy understanding.

In the coating solution has a surface tension to make the size of a surface of the coating solution minimum. The tension causes the vena contracta in the coating solution, and is at the maximum in the bead. The reason is as follows:

(1) before reaching the web, the coating solution leaves the edge plates which has been regulated the coating solution;

(2) as the coating solution is extended in a lengthwise direction in the bead, the vena contracta is generated not only in a direction of thickness but also in a widthwise direction;

(3) the extending causes to decrease the density of the surface active agent on a surface and to increase the surface tension for minimizing the size of the surface of the coating solution. The vena contracta in the coating solution 17 enlarges the thickness of the edge of the bead 18, which causes a defect in drying.

Figure 5:
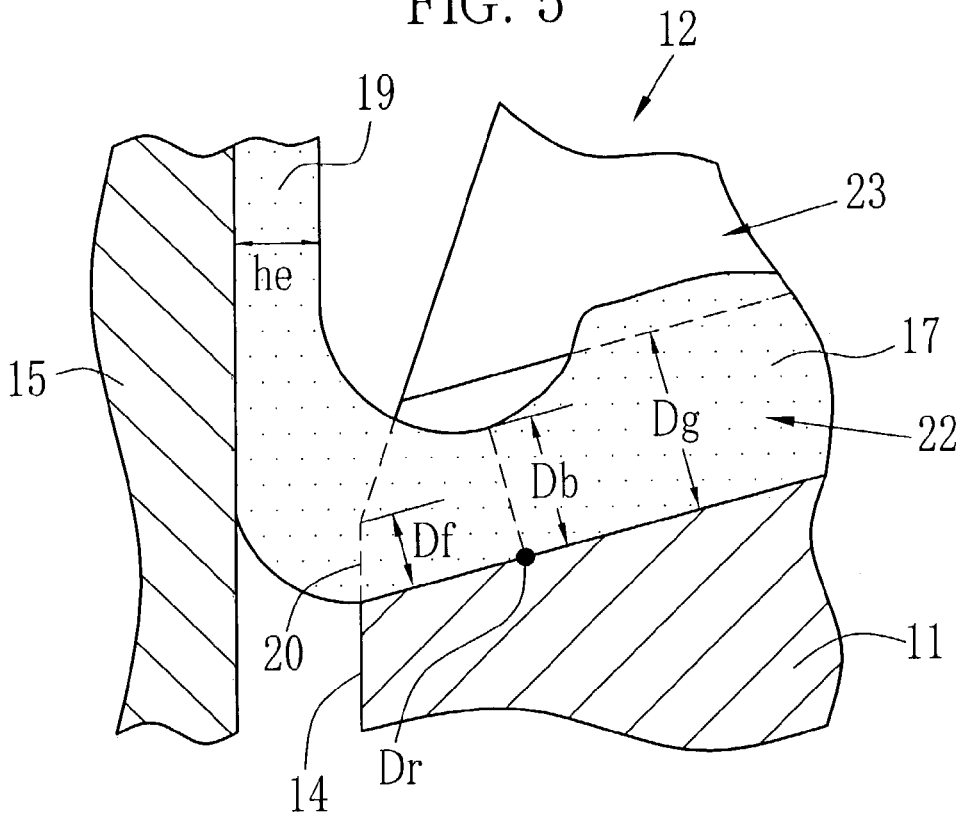
FIG. 5 is a sectional view of the coating apparatus, which illustrates an adequate shape of the edge plate.

As shown in FIG. 5, a position at which the thickness of the coating liquid 17 becomes minimum on the slide surface 13 is determined as a minimum thickness position Dr by vena contracta. The height Dg of the perpendicular wall 22 of the edge plate 12 is larger than a minimum thickness Db of the bead 18. As the flow of the coating solution 17 is regularized by the perpendicular wall 22, the bead 18 that is caused by the vena contracta is hardly deformed. Thus a thickness "he" of the coating layer 19 on the web 15 becomes constant. Note that the lowest, middle and uppermost sub-layers 19*a*–19*c* in the coating layer 19 are omitted in FIG. 5 and the following figures for easiness of understanding.

In order to make the coating of the solution 17 adequately, it is preferable to satisfy the condition Df≦Db. Further, it is preferable the height Df of the end face 20 satisfies the condition 0 mm<Df≦0.6 mm. However, the height Df is not restricted in this condition.

Figure 6:
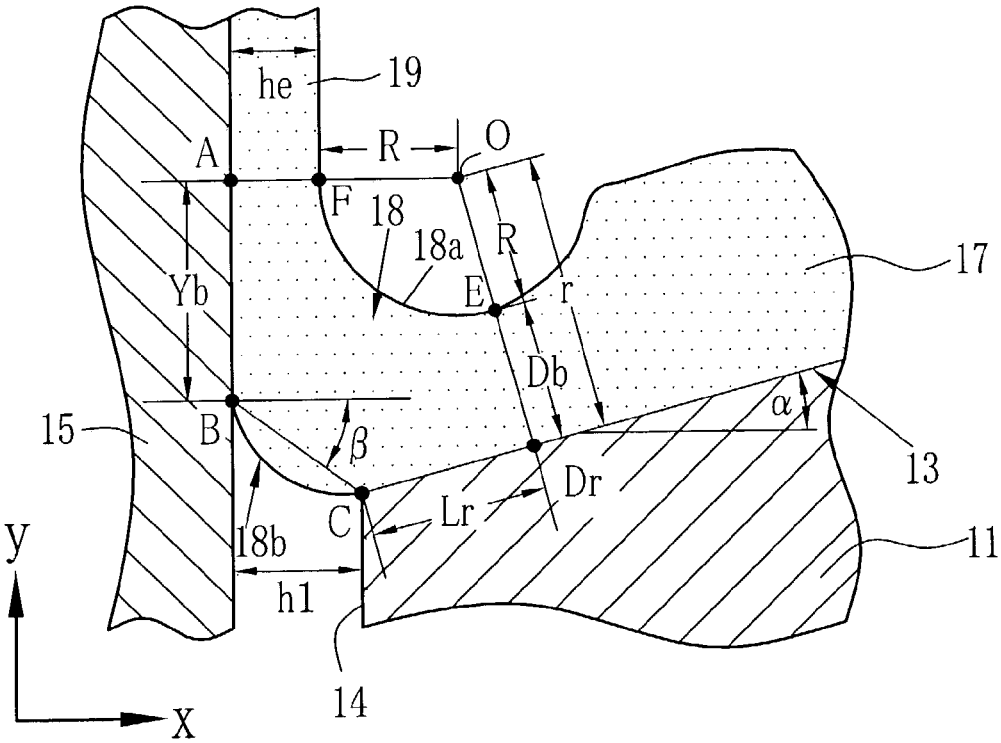
FIG. 6 is an explanatory view illustrating a shape of a bead formed of the coating solution when in applied on the web.

The minimum thickness Db of the bead 18 can be calculated. As shown in FIG. 6, an angle α is that between the slide surface 13 and a horizontal line. An upper meniscus 18*a* of the bead 18 is an arc whose radius of curvature is R. A center of the arc is determined as a point O, which is represented as (0,0) in X-Y Cartesian coordinate. A point F is an end of the upper meniscus 18*a*. Then the distance between the point F and the point O is the radius R of curvature. Hens & Boiy "Chemical Engeneering Science Vol. 41, P. 1827–1831 (1986)" discloses the following formular:

$$R=2\times he\times\{\sigma/(\eta\times U)\}^{1/3}, \quad (1)$$

herein he is the thickness (mm), σ is a surface tension, η is a average of viscosity (mPa·S) of coating solution at a share rate in flowing on the slide surface, and U is a feed velocity (m/s) of the web 15. Further, the line O-F is extended toward the web 15 and the extended line reaches the web 15 at a point A. The point A is represented as (−R−he,0). Note that the radius of the back-up roller is much larger than the radius R of the bead 18*a* and the thickness he. Accordingly, part of the periphery illustrated in FIG. 6 can be regarded as a perpendicular line.

At a point B, a lower meniscus 18*b* of the bead 18 contacts to the web 15 in FIG. 6. The point B is represented as (−R−he, Yb) in the Cartesian coordinate. The length Yb is a distance between the point A and the point B, and known as an expulsion thickness which is a length necessary for the coating solution 17 to form on the web 15 the coating layer 19 having the thickness he. The Publication of J. Hens & L. Boiy "Chemical Engeneering Science Vol. 41, P. 1827–1831 (1986)" discloses that the following formula is satisfied after a theory of boundary layer of Sakiadis:

$$Yb=0.383\times(\rho\times U\times he^2/\eta). \quad (2)$$

At point C, the coating solution 17 leaves the uppermost of the lip 14. A line B-C between the point B and the point C reaches the horizontal line at an angular β. Accordingly, the point C is represented as (−R−he+h1, −Yb−h1×tan β) in the Cartesian coordinate.

A line O-Dr is perpendicular to the slide surface 13, and crosses with an upper meniscus 18*a* of the bead 18 at a point E. Accordingly, the length of a line Dr-E is determined as a minimum thickness Db of the bead 18, and a length from a front end of the slide surface to the minimum thickness position Dr of bead is determined as the length Lr of a line C-Dr. The minimum thickness position Dr of bead is represented as (Dx, Dy) in Cartesian coordinate, and Dx and Dy are calculated as follows.

If the point C is represent as (Cx, Cy), the formula of the line C-Dr is:

$$Y=\tan\alpha\times(x-Cx)+Cy. \quad (3)$$

According to the line O-Dr:

$$\tan\alpha=-x/y, \text{ therefore:}$$

$$y=-x/\tan\alpha. \quad (4)$$

The formula (3) and (4) are solved according to (x, y):

$$x=\sin\alpha\times\cos\alpha\times(Cx\times\sin\alpha/\cos\alpha-Cy)=Dy \quad (5)$$

when the above formula (5) is solved according to y:

$$y=-\cos^2\alpha\times(Cx\times\sin\alpha/\cos\alpha-Cy)=Dy \quad (6)$$

Herein, in order to obtain formulae representing Dx and Dy, the coordinate of Cx and Cy are used:

$$(Cx,Cy)=(-R-he+h1,-Yb-h1\times\tan\beta). \quad (7)$$

As "R" and "Yb" can be diminished from the formula (7) and (1),

Cx and Cy are represented as follows.

$$Cx=h1-he\times[1+2\times\{\sigma/(\eta\times U)\}^{1/3}] \quad (8)$$

$$Cy=-0.383\times(\rho\times U\times he^2/\eta)-h\times\tan\beta \quad (9)$$

As shown in FIG. 6, a formula Db=r−R is satisfied. Further, a formula of a circle whose radius is r and whose central point is (Dx,Dy) is as follows.

$$r=(Dx^2+Dy^2)^{1/2} \quad (10)$$

$$Db=(Dx^2+Dy^2)^{1/2}-R \quad (11)$$

In order to solve according to $Dx^2+Dy^2$, the formula (10) is solved from the formula (5) and (6) as follows:

$$Dx^2+Dy^2=\cos^2\alpha\times(Cx\times\sin\alpha/\cos\alpha-Cy)^2 \quad (12)$$

From the formula (11) and (13):

$$Db=Cx\times\sin\alpha-Cy\times\sin\alpha-R \quad (13)$$

From the formula (8), (9) and (13):

$$Db=(\sin\alpha+\tan\beta\times\cos\alpha)\times h1-\sin\alpha\times he-2\times(\sin\alpha+1)\times(\rho/\eta)^{1/3}\times he\times U^{-1/3}+0.383\times\cos\alpha\times(\rho/\eta)\times he^2\times U \quad (14)$$

Further, considering the following conditions:

$$b1=(\sin\alpha+\tan\beta\times\cos\alpha)$$

$$b2=-\sin\alpha$$

$$b3=-2\times(\sin\alpha+1)\times(\sigma/\eta)^{1/3}$$

$$b4=0.383\times\cos\alpha\times(\rho/\eta)$$

the formula (14) is represented with use of b1–b4 as follows:

$$Db=b1\times h1-b2\times he-b3\times he\times U^{-1/3}+b4\times he^2\times U \quad (15)$$

In the formula (14), regions of value of α, β, σ, ρ, η are as follows:

α (inclination angle of slide surface)=0°–30°

β (contact angle)=50°

σ (surface tension)=20–70 mN/m

ρ (averaged density of coating solution)=100 kg/m$^3$

η (averaged viscosity of coating solution at share rate)= 30–50 mPa·s

Note that the value of the contact angle β is reported in "AIChE Spring meeting (1988)" by Katagiri. In the condition of β= 50°, the coating solution is applied on the web stably.

b1–b4 has the following values when in using the value of α, β, σ, ρ and η:

b1=0 to 1.03 b2=−0.5 to (−0)

b3=−4 to (−1.5)

b4=6634 to 12767

Considering the significant digit, $$b1=1.03,\ b2=-0(=0),\ b3=-1.50,\ b4=12800,$$

then, $$Db=1.03\times h1-1.50\times he\times U^{-1/3}+12800\times he^2\times U \quad (16)$$

When the minimum thickness Db of the perpendicular wall 22 is enough large, the contraction is prevented. However, when the minimum thickness Db is too large, the thickness of the coating layer 19 on the web 15 becomes inconstant in the widthwise direction. The reason therefor is that the boundary layer of Blasius develops more on the slide surface. In order to prevent it, it is preferable that almost of the coating solution flows in lower part of a top of the perpendicular wall 22 on the slide face 13.

An upper limit Ds of the height Dg of the perpendicular wall 22 is calculated from the following formula shown in "Transport Phenomena (Willey; 1960) P. 35–40" by R. B. Bird et al.

$$Ds(m)=\{3\times\eta\times q/(\rho\times g\times\sin\alpha)\}^{1/3} \quad (17)$$

herein, η is averaged viscosity of the coating solution at sharing rate when in flowing on the slide surface, q is a total amount of the flowing coating solution for a predetermined width, ρ is a averaged density of coating solution, and g is the acceleration of gravity.

Now, the minimum thickness position Dr of bead is calculated. According to the formula cos α=(Dx−Cx)/Lr:

$$Lr=(Dx-Cx)/\cos\alpha \quad (21)$$

The formula 5 is put into Dx of the formula (21), then $$Lr=\{\sin\alpha\times\cos\alpha\times(Cx\times\sin\alpha/\cos\alpha-Cy)-Cx\}/\cos\alpha \quad (22)$$

therefore, $$Lr=-Cx\times\cos\alpha-Cy\times\sin\alpha \quad (23)$$

The formulae (8) and (9) are put into Cx and Cy of the formula (23) respectively, then $$Lr=-\cos\alpha[h1-he\times\{1+2(\sigma/(\eta\times U))^{1/3}\}]-\sin\alpha\times\{-0.383\times(\rho\times U\times he^2/\eta)-h1\times\tan\beta\} \quad (24)$$

The formula (24) is transformed as follows:

$$Lr=(-\cos\alpha+\sin\alpha\times\tan\beta)\times h1+\cos\alpha\times he+2\times\cos\alpha\times(\sigma/\eta\times U)^{1/3}\times he\times U^{-1/3}+0.383\times\sin\alpha(\rho/\eta)\times U\times he^2 \quad (25)$$

herein h1 is the distance between the web and the die, he is the thickness of the coating layer, and U is a moving velocity of the web.

When the following substitutions are used;

$$r1=(-\cos\alpha+\sin\alpha\times\tan\beta)$$

$$r2=\cos\alpha$$

$$r3=2\times\cos\alpha\times(\sigma/\eta)^{1/3}$$

$$r4=0.383\times\sin\alpha\times(\rho\times\eta)$$

then the formula (25) is transformed as follows:

$$Lr=r1\times h1+r2\times he+r3\times he\times U^{-1/3}+r4\times U\times he^2 \quad (26)$$

Further, regions of value of α, β, σ, ρ, η are as follows in the formulae representing r1 to r4:

α (inclination angle of slide surface)=0° to 30°

β (contact angle)=50°

σ (surface tension)=20 to 70 mN/m

ρ (averaged density of coating solution)=1000 kg/m$^3$

η (averaged viscosity of coating solution at share rate)= 30 to 50 mPa·s r1 to r4 have the following values when in using the value of α, β, σ, ρ and η:

r1=−1.0 to −0.27 r2=0.87 to 1.0 r3=−2.5 to (−1.3)

r4=0 to 5319

Considering the significant digit of the above values, the formula (26) is:

$$Lr=-0.270\times h1+1.00\times he-1.30\times he\times U^{-1/3}+5320\times U\times he^2 \quad (27)$$

The tensional rate of surface of the coating solution is the highest at the minimum thickness position Dr of bead where the distance between the upper meniscus and the slide surface is the smallest. Accordingly, the substitutive force of the upper meniscus of the bead tense to the edge plate is most effectively applied at the minimum thickness position Dr of bead. Thereafter, when reaching the web, the coating solution is tensed furthermore. However, the tensional rate is lower than at the minimum thickness position Dr of bead. Accordingly, it is necessary for preventing the contraction that the minimum thickness Db of bead is smaller than the height Dg, and that the edge plate is provided at the minimum thickness position Dr of bead. Therefore, it is required to satisfy the following condition:

$$Db \leqq Dg \leqq Ds \quad (31)$$

The coating solution is applied without generating contraction by using the edge plate which satisfies the condition of the formula (31).

Figure 7:
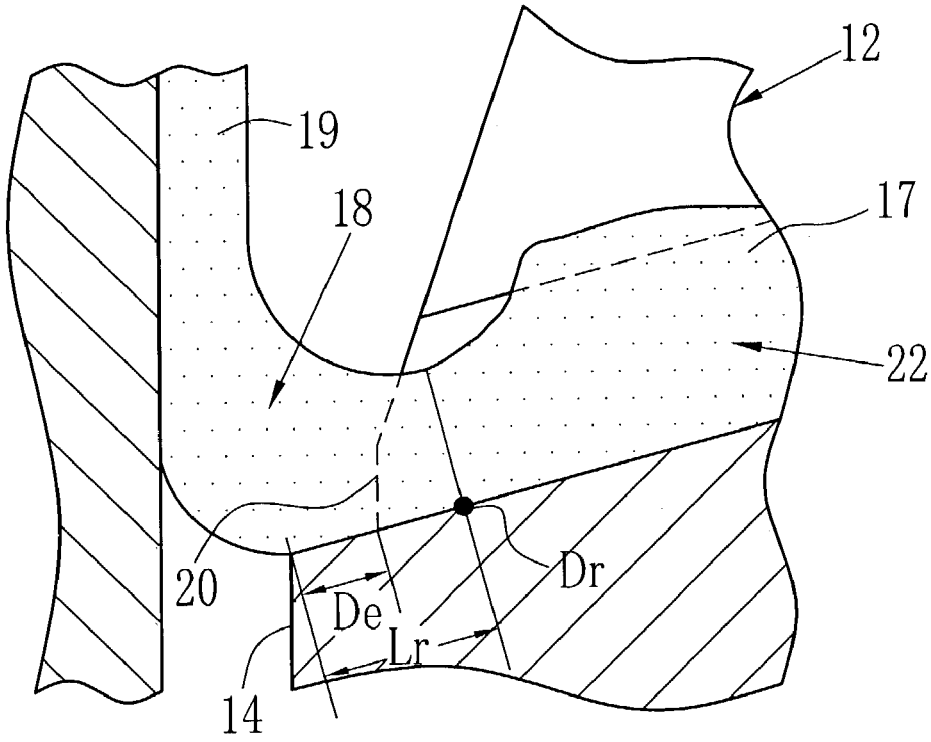
FIG. 7 is an enlarged view illustrating a front part of another embodiment of the coating apparatus of the present invention.

When the condition of the formula (31) is satisfied, the end face 20 of the edge plate 12 may be retracted from the lip 14 of the die 11. In FIG. 7, there is a distance De between the end face 20 and the lip 14. The distance De and the length Lr have a relation De≦Lr.

Figure 8:
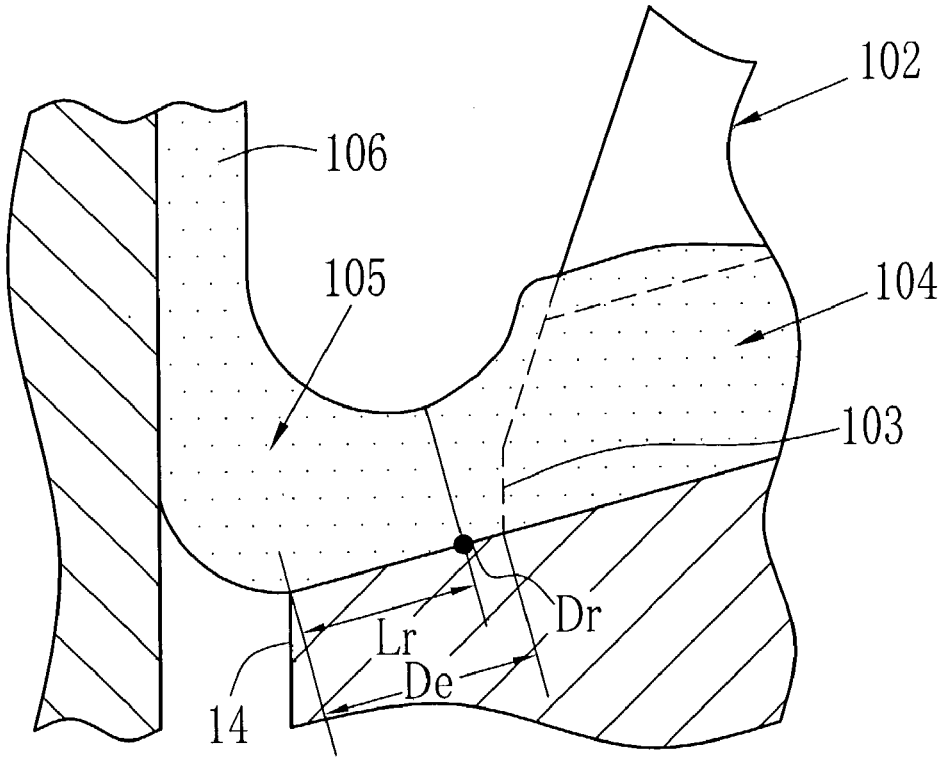
FIG. 8 is a diagrammatic view illustrating an inadequate positional relation between the edge plate and the die.

As shown in FIG. 8, the distance De between the lip 14 and an end surface 103 of an edge plate 102 is larger than the length Lr. In this case, a perpendicular face 104 is not provided at the minimum thickness position Dr. Accordingly, the contraction causes a deformation of a bead 105, which makes hard to form a coating layer 106 at a constant thickness.

Figure 9:
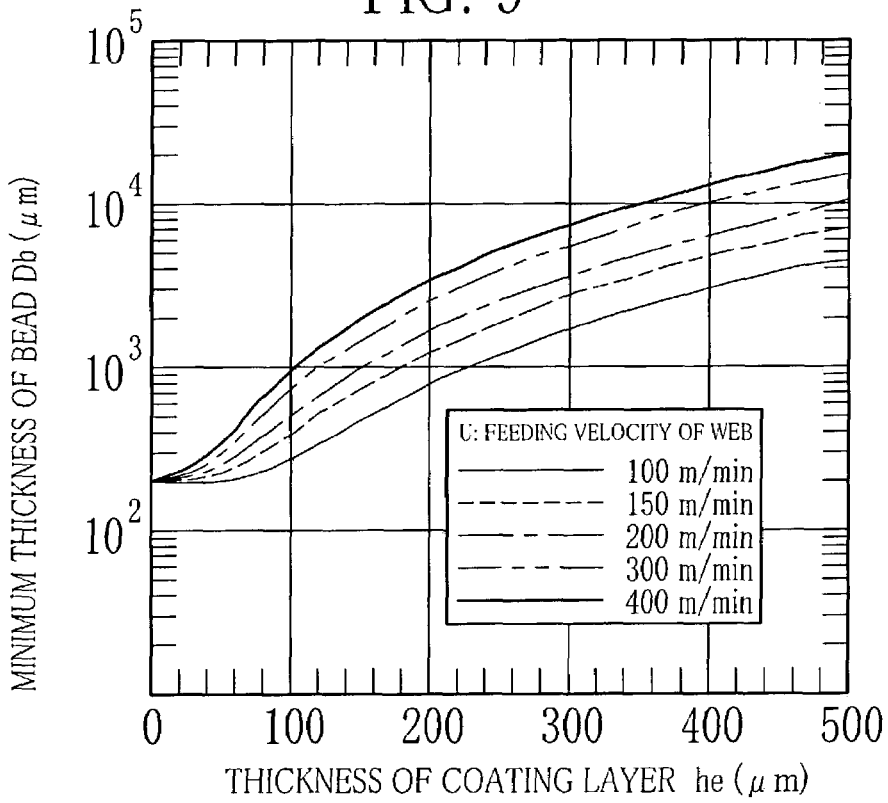
FIG. 9 is a graph illustrating a relation between a minimum thickness of bead and a thickness of the coating layer.

FIG. 9 illustrates a relation between the thickness he of the coating layer and the minimum thickness Db of bead according to several feeding velocities U of the web. Note that the distance h1 between the web and the lip of the die is set to 200 μm. In order to form the coating layer having a constant thickness, the minimum thickness Db of bead must be larger when in applying at the larger feeding velocity U of the web, and therefore the larger amount of the coating solution is supplied. The minimum thickness Db of bead is usually more than about 0.2 mm. The conditions for calculating the upper limit Ds of the height of the perpendicular wall 22 are as follows:

The averaged viscosity η of coating solution at the share rate in flowing on the slide surface is 30 (mPa·S), a total amount q of the flowing coating solution for a predetermined width is 0.001 $\{m^3/(m \times sec)\}$, the angle α of the slide surface is 15°, the averaged density ρ of coating solution is 1000 $(kg/m^3)$, the acceleration of gravity is 9.8 $(m/sec^2)$.

When these values are put into the formula (17), the upper limit Ds is 1.5 mm. Accordingly, the height Dg of the perpendicular wall can be 0.15 mm≦Dg≦5 mm, preferably 0.2 mm≦Dg≦1.5 mm. However, in the present invention, the height Dg of the perpendicular wall is not restricted in the region of value.

Figure 10:
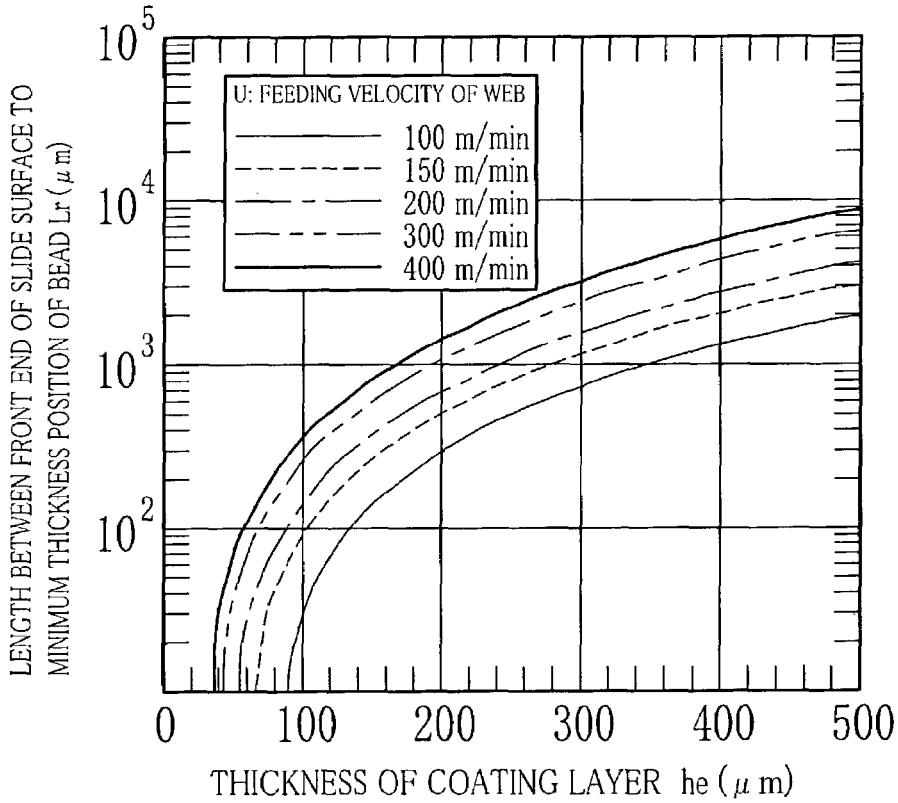
FIG. 10 is a graph illustrating a relation between a minimum thickness position of bead and the thickness of the coating layer.

FIG. 10 illustrates a relation between the thickness he of the coating layer and the length Lr from the lip to the minimum thickness position Dr of bead according to several feeding velocities U of the web. Note that the distance h1 between the web and the lip of the die is set to 200 μm. In order to form the coating layer with a constant thickness, the length Lr must be larger when in applying at the larger feeding velocity U of the web.

Figure 11:
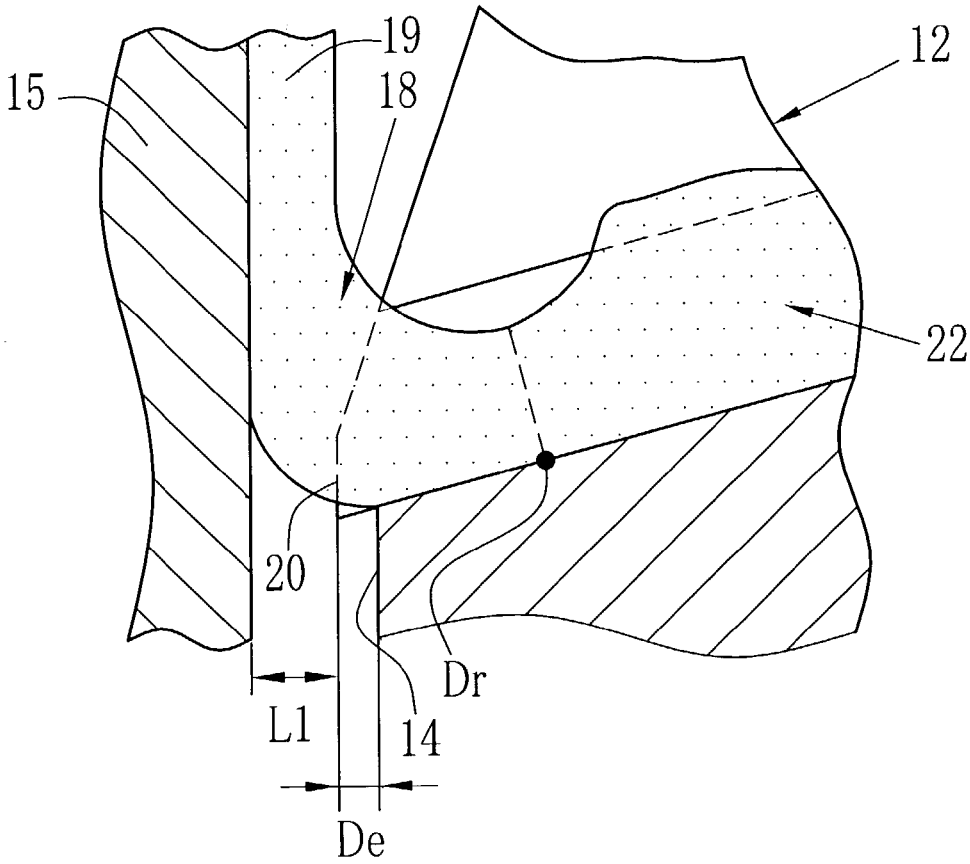
FIG. 11 is a diagrammatic view of a third embodiment of the coating apparatus of the present invention.
Figure 12:
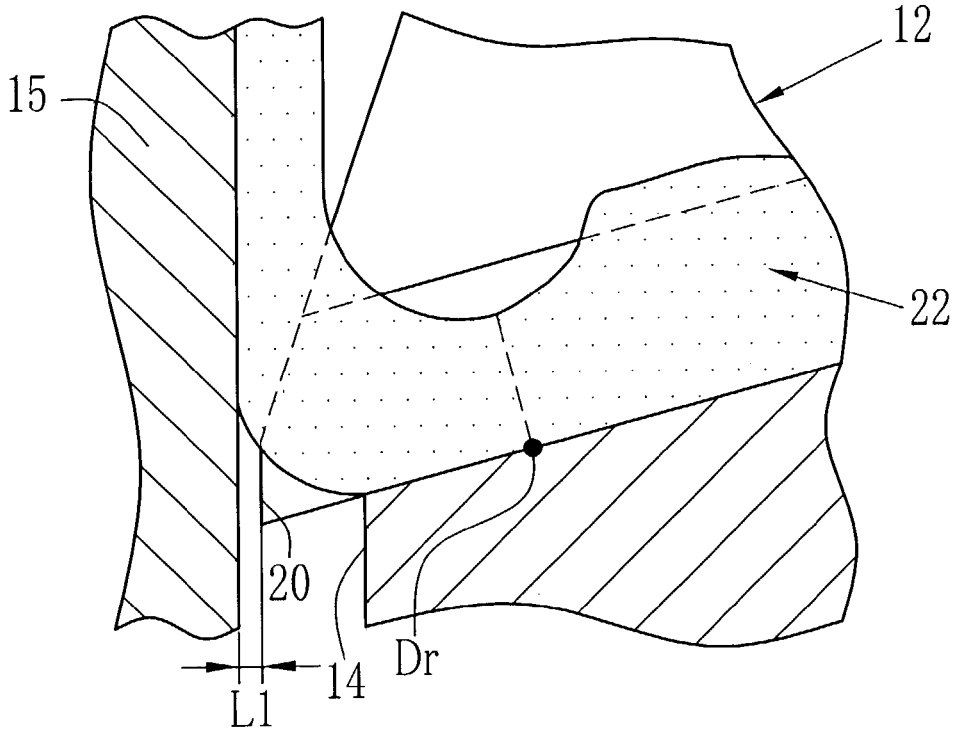
FIG. 12 is a diagrammatic view illustrating an inadequate positional relation between the edge plate and the web.

In FIG. 11, the end face 20 of the edge plate 12 is positioned closer to the web 15 than the lip 14. In this embodiment, the perpendicular wall satisfies at the minimum thickness position Dr of bead the condition Db≦Dg. Accordingly, the coating layer 19 is formed to have a constant thickness. Otherwise, as shown in FIG. 12, the end face 20 is positioned too close to the web 15. In this case, the end surface 20 often contacts to the web 15. In the present invention, it is preferable that a nearest interval L1 between the end surface 20 to the web 15 may be L1≧100 μm.

Figure 13A:
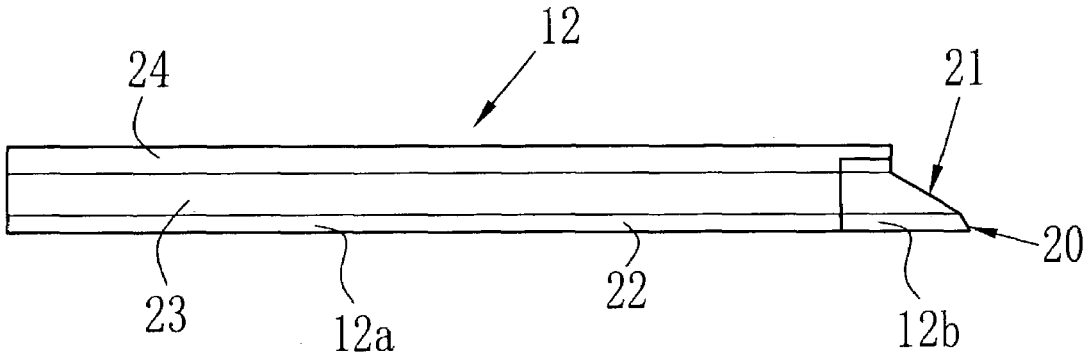
FIG. 13A is a side view of another embodiment of the edge plate.
Figure 13B:
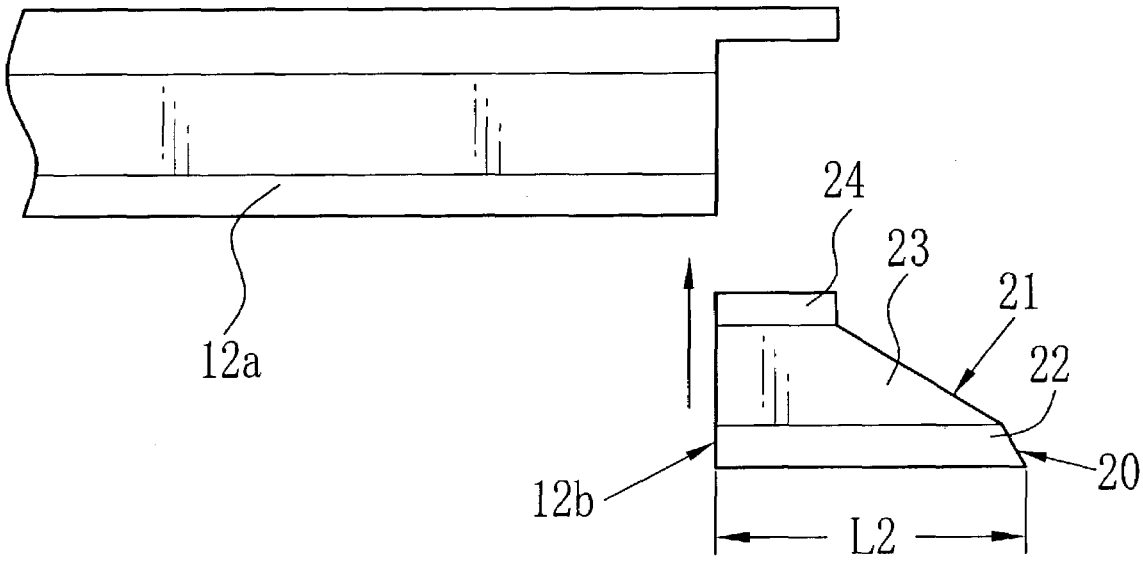
FIG. 13B is a side view the same as FIG. 13A, which illustrates a situation of attachment of an end block to a plate body of the edge plate.
Figure 13C:
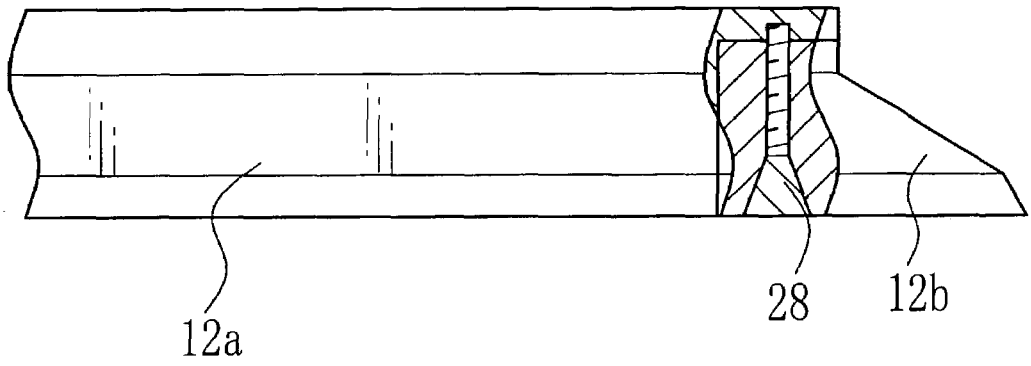
FIG. 13C is a sectional view of FIG. 13A, which illustrates a situation that the end block and the plate body is fixed by a screw.

As the fine processing is made on an inner side in a forward part of the edge plate, the forward part is easily broken. As shown in FIG. 13A, the edge plate 12 is constituted of a plate body 12*a* and a removable end block 12*b*. As shown in FIG. 13B, the end block 12*b* has the perpendicular wall 22, the inclined wall 23 and the upper wall 24. When the end block 12*b* is broken, another end block 12 may be attached to the plate body 12*a*. Further, it is preferable that a length of the end block 12*b* is 10–50 mm. However, the length is not restricted in it. As shown in FIG. 13C, the end block 12*b* is fixed with a screw 28 to the plate body 12*a*. Note that although the number of the screw 28 illustrated in FIG. 13C is only one, plural screws may be used for fixing the end block 12*b* to the plate body more strongly.

Figure 14:
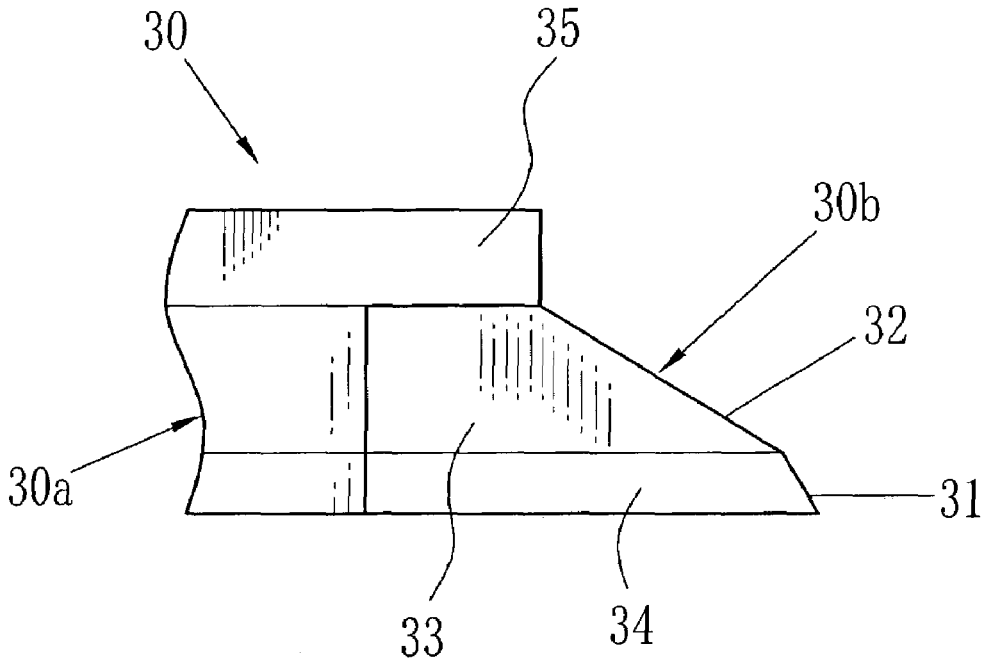
FIG. 14 is a side view of a third embodiment of the edge plate.
Figure 15:
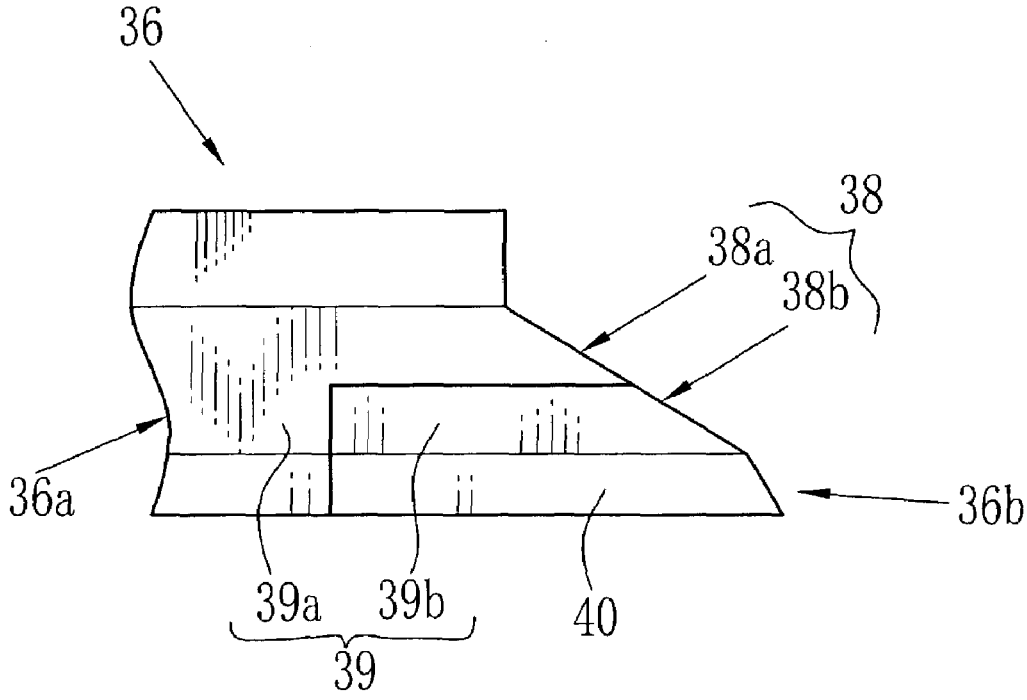
FIG. 15 is a side view of a forth embodiment of the edge plate.

In FIG. 14, the edge plate 30 is constructed of a plate body 30*a* and an end block 30*b*. The end block 30*b* has a front inclination 32, an inclined wall 33 and a perpendicular wall 34. An upper wall 35 is provided only with the plate body 30*a*. Further, as shown in FIG. 15, an end block 36*b* of an end plate 36 has only a part 38*b* of an inclination 38, a part 39*b* of an inclined face 29, and a perpendicular wall 40. In this case, the inclination 38 is separated into a part 38*a* and the part 38*b* of the inclination 38, and the inclination face 39 is separated into a part 39*a* and the part 39*b*. As illustrated in the above figures, there are several types of the end blocks having several shapes.

Figure 16:
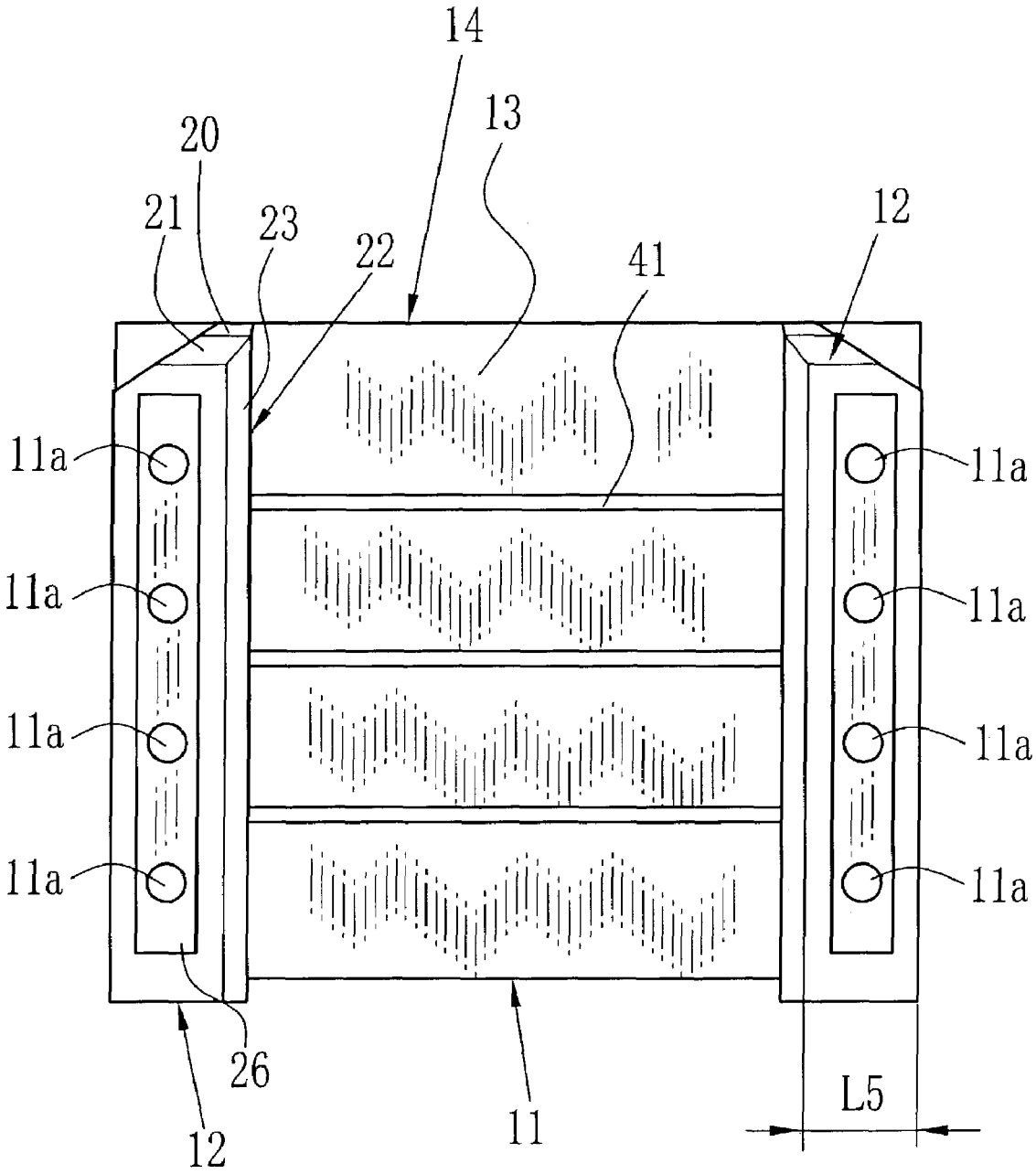
FIG. 16 is a plan view of a top of the coating apparatus of the present invention.
Figure 17:
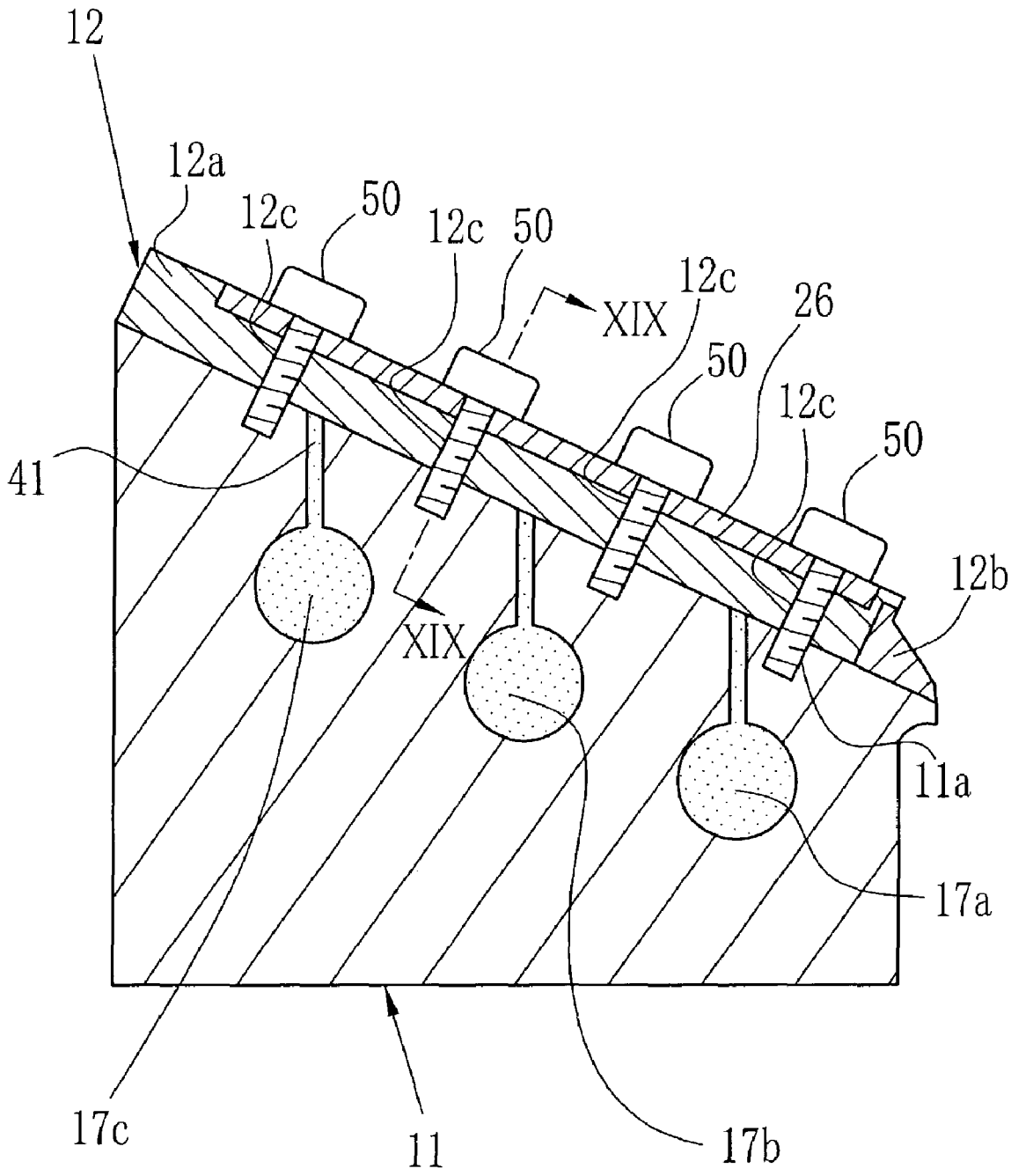
FIG. 17 is a vertical sectional view of the coating apparatus.

In FIG. 16, a top of the edge plate 12 has a width L5, and a heartwood 26 fills a retraction formed on a top of each edge plate 12. Screw holes 11*a* are formed in the heartwood 26. As shown in FIG. 17, screw holes 12*c* are formed in the plate body 12*a*, so as to be positionarily corresponding to the screw holes 11*a*. When a screw 50 is inserted through the heartwood 26 into the screw holes 12*c* and 11*a*, the edge plate 12 is fixed to the die 11. Thus the distribution of the coating solution becomes adequate, which causes to prevent the damage of the web or a disorder of the edge of the coating layer. Accordingly, the coating solution is stably applied on the web. Further, it is preferable to fix the edge plate 12 from an inner side with the screw 50. Thus the position of the plate 12 is fixed on the die 11 accurately.

Considering heat deformation, it is preferable to form the screw 50 with the same material as the die 11. The material may be metal such as stainless and the like, polymers such as fluoride resin, acetal resin, acryl resin, and another nonmetals. Further, the number of the screw 50 for fixing the edge plate 12 on the die 11 is not restricted in four, which is shown in FIG. 17. A method for fixing the die 11 and the edge plate 12 is not restricted in using the screw 50, and may be one of the methods for fixing that are already known.

The material for forming the edge plate 12 is not especially restricted. However, it is preferable that the perpendicular wall 22 and the inclined wall 23 are formed of a nonmetal such as polymers, in order to prevent the corrosion. It is especially preferable to use the fluoride resin which is excellent in a anticorrosion.

Note that the die 11 has three manifolds 55*a*, 55*b*, 55*c* connected with the slits 41. Three solution elements 19*a*, 19*b*, 19*c* of the coating solution 17 are filled in the manifolds 55*a*–55*c*, respectively.

Figure 18:
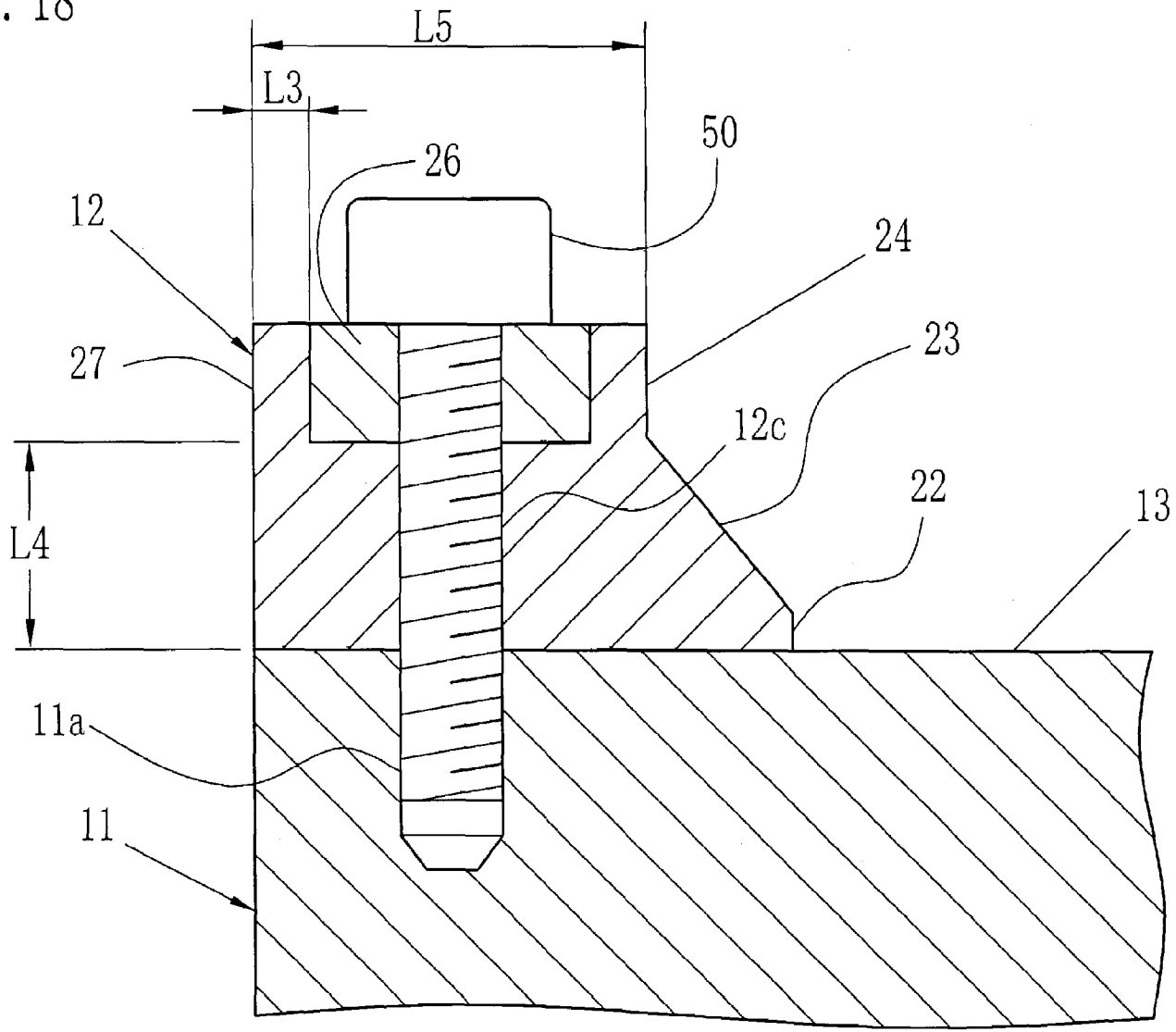
FIG. 18 is an exploded sectional view of the edge plate and the die.

As shown in FIG. 18, the heartwood 26 is positioned to have a length L3 from an outer surface and a length L4 from a bottom of the edge plate 12. It is preferable that the length L3 is more than 1 mm, and the length L4 is more than 3 mm, with consideration of strength of the edge plate 12. However, the shape of the heartwood 26 is not restricted in that of this figure. It is preferable that the heartwood 26 is made of stainless although other metal is used. Further, nonmetal may be used. As the nonmetal, there is the engineering plastic (for example, polycarbonate and the like) that has an excellent strength.

Preferably the width L5 is 20 to 100 mm. When the width L5 is less than 20 mm, it is hard to fit the heartwood 26 in the edge plate 12. However the width L5 is not restricted in this description.

Figure 19:
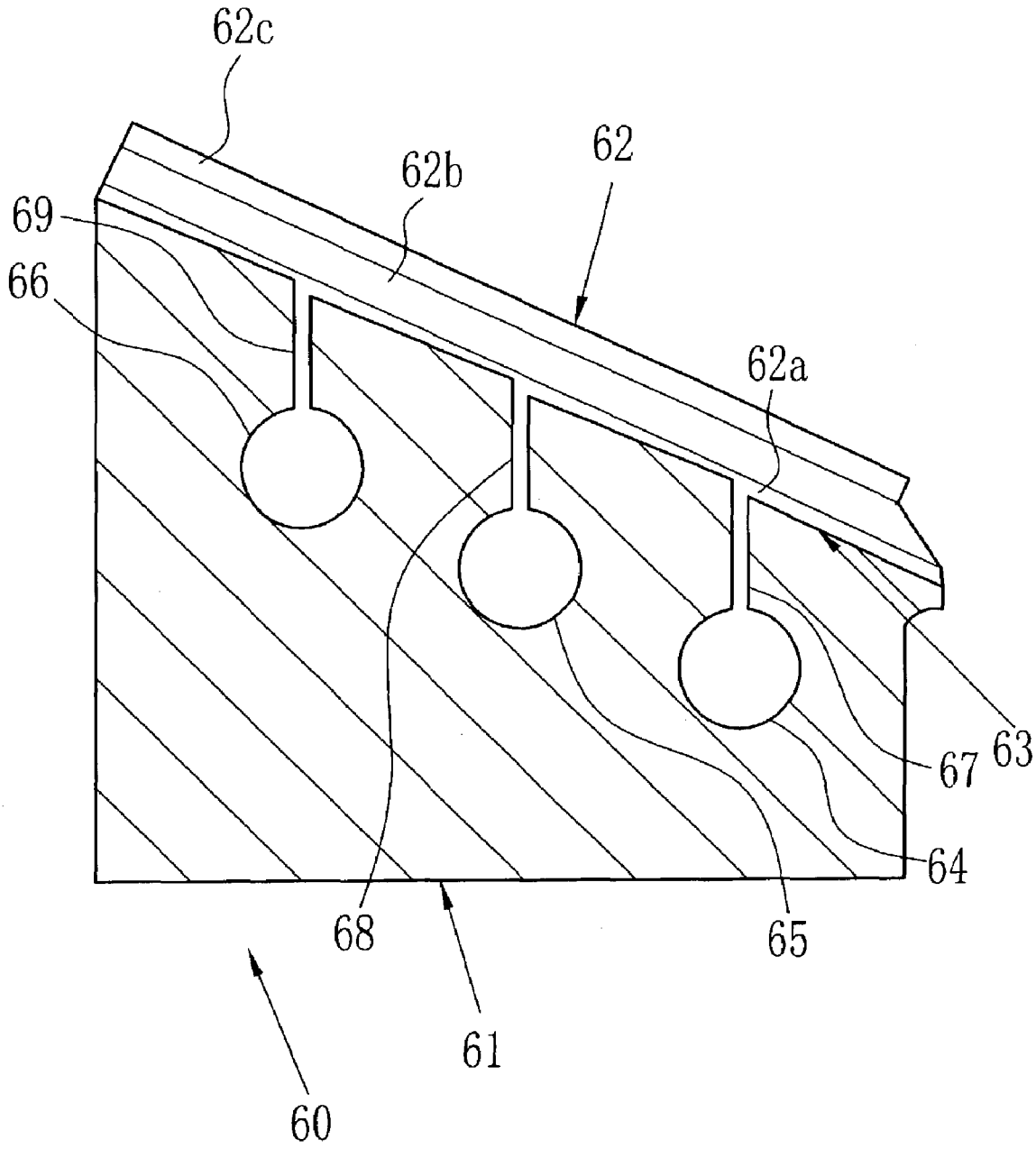
FIG. 19 is a sectional view of another embodiment of the die.

Note that the shape of the perpendicular wall 22 is not restricted in the above embodiment. Further, a coating apparatus 60 illustrated in FIG. 19 may be used in the present invention. In the coating apparatus 60, an edge plate 62 is attached to a die 61 (the screws are omitted in FIG. 19). The edge plate 62 has a perpendicular wall 62*a*, an inclined wall 62*b* and an upper wall 62*c*. On a slide surface 63 are formed three slits 67, 68, 69 which are connected with manifolds 64, 65, 66, respectively. Further, the slide surface drops at each of the slits 67–69. In the coating apparatus 60, the height Dg of the perpendicular wall 62 satisfies the condition $Db \leqq Dg \leqq Ds$.

Figure 20:
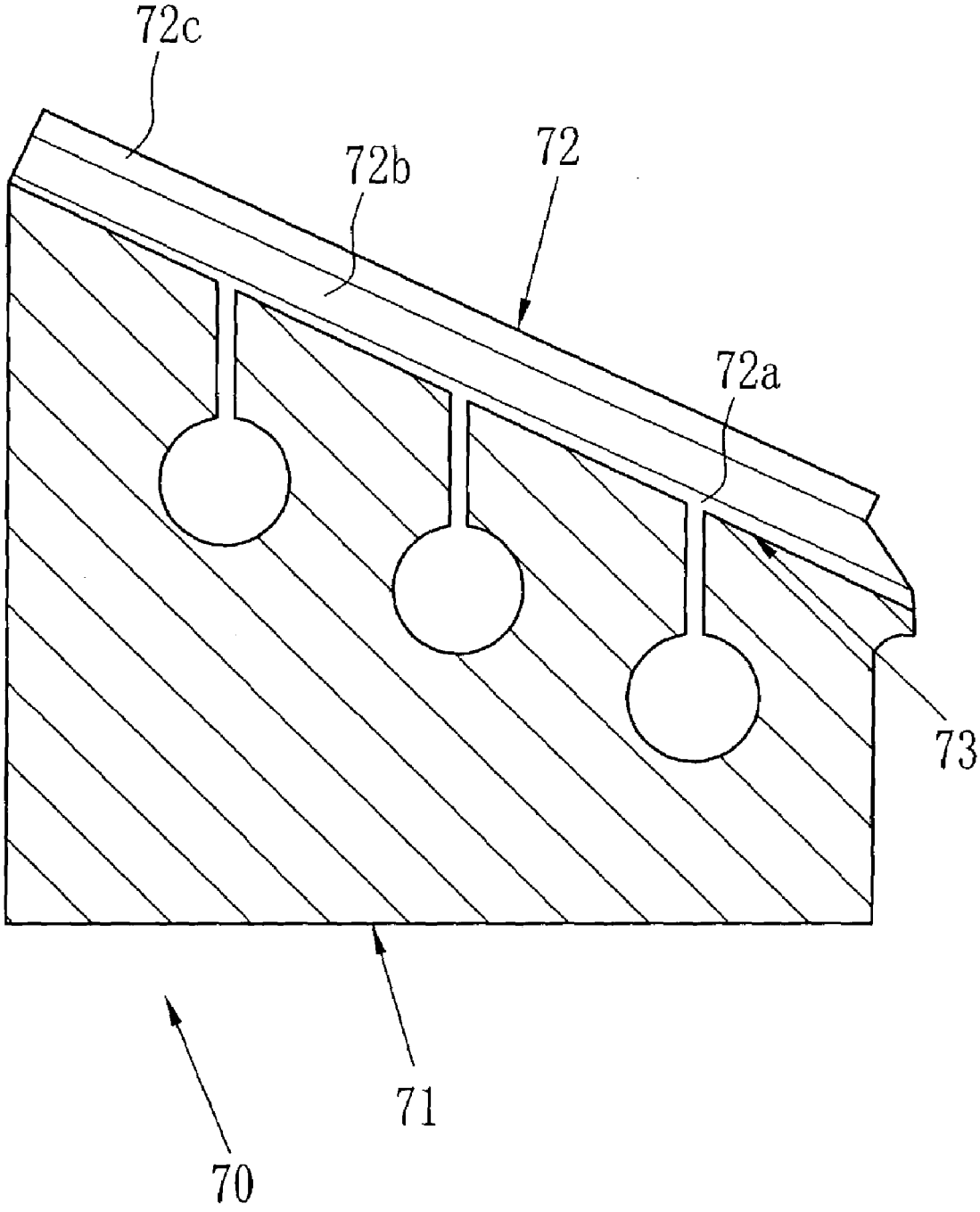
FIG. 20 is a sectional view of a third embodiment of the die.
Figure 21:
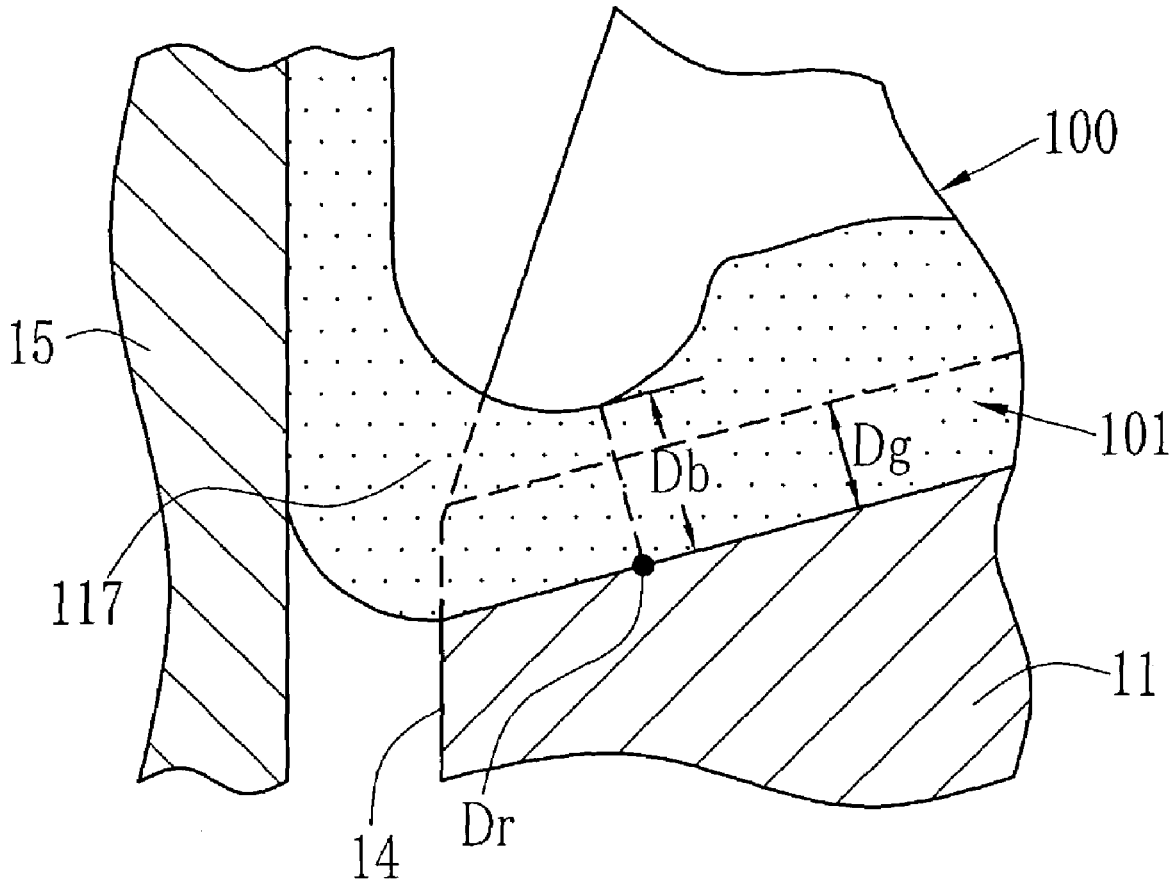
FIG. 21 (PRIOR ART)
FIG. 21 is a sectional view illustrating a front part of a coating apparatus of a prior art.

Also a coating apparatus 70 illustrated in FIG. 20 may be used in the present invention. In the coating apparatus 70, an edge plate 72 is attached to a die 71 (the screws are omitted in FIG. 20). The edge plate 72 has a perpendicular wall 72*a*, an inclined wall 72*b* and an upper wall 72*c*. The perpendicular wall 72*a* is formed so as to become wider in downstream. In the coating apparatus 70, the height Dg of the perpendicular wall 72 satisfies the condition $Db \leqq Dg \leqq Ds$.

EXAMPLES

In followings, examples of the present invention are described. However, the present invention is not restricted in them.

<Experiment 1>

In Experiment 1, there are examples 1–9 and comparisons 1 and 2, in which respective conditions are determined when in applying the coating solution. At first, an explanation about the example 1 is made in detail. In explanations about examples 2–9 and the comparisons 1 and 2, the same is omitted.

Example 1

The first to third solution elements of the coating solution were prepared for forming the lowest, middle and uppermost sub-layer, respectively. The first solution element contained gelatin (4%), and the viscosity thereof was 80 mpa·s, and the amount of coating was 20 ml/m$^2$. The second solution element contained gelatin (8%), and the viscosity thereof was 150 mPa·s, and the amount of coating was 100 ml/m$^2$. The third solution element contained gelatin (6%), and the viscosity thereof was 40 mPa·s, and the amount of coating was 10 ml/m$^2$. The viscosity of each of the three solution elements was adjusted by adding the polyvinyl sulfonic acid. A dyne was added into the second solution element for the middle sub-layer, and thickness of the coating layer formed on the web was evaluated from an optical density. An aerosol OT was added in the third solution element for the uppermost sub-layer, to adjust the surface tension to $27\times10^{-3}$ (N/m).

In order to apply the above coating solution on the web, the coating apparatus 10 illustrated in FIG. 1 was used. Thus three sub-layers 19*a*–19*c* were formed on the web simultaneously in a slide bead method. According to the edge plate 12, the angle D1 of the inclined wall 22 was 45°, the angle D2 of the front inclination 21 is 60°, and the height Dg of the perpendicular wall is 0.6 mm. The angle α of the slide surface 13 was 15°. The end face 20 protrudes from the lip 14 of the die 11, and the distance De between the end face 20 and the lip 14 was 0.07 mm (=70 μm), as shown in FIG. 3. Further, the difference ($P_0$–$P_b$) of pressures between the upper and lower meniscuses of the bead was 490 Pa, and the temperature of the surface of the web 15 was 36° C.

The velocity of coating of the coating solution was 2 m/s. The temperature of the coating the coating solution was 35° C. Thereby the averaged density ρ of the coating solution was 1000 kg/m$^3$. The total flowing amount q of the coating solution in a predetermined width was $3\times10^{-4}$ m$^3$/(m×sec). The viscosity η of the coating solution at the share rate on the slide surface was 100 mPa·s. The upper limit Ds of the height Dg of the perpendicular wall 22 was calculated from these conditions of ρ, q, η, the angle α of the slide surface and the acceleration g (m/sec$^2$) of gravity, to be 3.288 mm.

Note that a TAC was used as the web 15. According to the coating condition, the moving velocity U of the web was 2 m/sec, the distance h1 between the lip and the web was 0.20 mm. The thickness he of the coating layer 19 was 0.15 mm. The minimum thickness Db of bead was calculated by putting these values of U, h1 and he into the formulae (15) and (16). The minimum thickness Db of bead was 0.181 mm.

The thickness of coating layer of each sample film was measured at a position 10 mm from edges. The thickness at the position was compared with the thickness at the middle position in the widthwise direction of the sample film. In the experiment 1, the difference of the thickness between at the position and the middle position was less than 1%. Further, conditions in the edges of the coating layer were checked with eyes. The result thereof was "good".

Examples 2–9 and Comparisons 1 and 2

In Examples 2–9 and Comparisons 1 and 2, some conditions is changed.

The conditions of Examples 1–9 and Comparisons 1 and 2 are shown in Tables 1–4 for easily understanding. In table 1 and 4, the distance De between the end face and the lip of the die has a negative value when the end face protrudes from the lip as shown in FIG. 11.

TABLE 1

| | FORM OF EDGE PLATE | | | | De | $P_0$–$P_b$ | T |
|---|---|---|---|---|---|---|---|
| | α (°) | D1 (°) | D2 (°) | Dg (mm) | (mm) | (Pa) | (° C.) |
| E1 | 15 | 60 | 45 | 0.6 | −0.07 | 490 | 36 |
| E2 | 15 | 60 | 45 | 0.6 | −0.07 | 588 | 42 |
| E3 | 15 | 60 | 45 | 0.6 | −0.07 | 686 | 30 |
| E4 | 15 | 60 | 35 | 1 | −0.07 | 343 | 30 |
| E5 | 15 | 60 | 45 | 0.6 | −0.07 | 686 | 30 |
| E6 | 15 | 60 | 45 | 0.6 | 0.1 | 686 | 30 |
| E7 | 15 | 60 | 45 | 0.6 | −0.07 | 588 | 35 |
| E8 | 10 | 60 | 75 | 0.5 | 0.05 | 882 | 30 |
| E9 | 20 | 60 | 75 | 0.5 | 0.05 | 882 | 30 |
| C1 | 15 | 60 | 45 | 5 | −0.07 | 588 | 42 |
| C2 | 15 | 60 | 45 | 0.1 | −0.07 | 686 | 30 |

α: Angle of slide surface 13
D1: Angle of inclined wall 23
D2: Angle of front inclination 21
Dg: Height of perpendicular wall 22
De: Distance between end face 20 and lip 14
$P_0$–$P_b$: Difference of pressure in bead
T: Temperature of web 15

TABLE 2

| | ρ (kg/m³) | Q {m³/(m × sec)} | η (mPa · s) | Ds (mm) |
|---|---|---|---|---|
| E1 | 1000 | $3 \times 10^{-4}$ | 100 | 3.288 |
| E2 | 1000 | $3 \times 10^{-4}$ | 50 | 2.610 |
| E3 | 1000 | $2.77 \times 10^{-4}$ | 200 | 4.032 |
| E4 | 1000 | $1.35 \times 10^{-4}$ | 20 | 1.474 |
| E5 | 1000 | $2.77 \times 10^{-4}$ | 200 | 4.032 |
| E6 | 1000 | $2.77 \times 10^{-4}$ | 200 | 4.032 |
| E7 | 1000 | $3.03 \times 10^{-4}$ | 140 | 3.692 |
| E8 | 1000 | $3.2 \times 10^{-4}$ | 70 | 3.407 |
| E9 | 1000 | $3.2 \times 10^{-4}$ | 70 | 2.718 |
| C1 | 1000 | $3 \times 10^{-4}$ | 50 | 2.610 |
| C2 | 1000 | $2.77 \times 10^{-4}$ | 200 | 4.032 |

ρ: Averaged density of coating solution
Q: Total amount of flowing coating solution in predetermined width
η: Averaged viscosity of coating solution at share rate
Ds: Upper limit of height of perpendicular wall 22

TABLE 3

| | COATING CONDITION | | | SHAPE OF BEAD | | RESULT | |
|---|---|---|---|---|---|---|---|
| | U (m/sec) | He (mm) | H1 (mm) | Db (mm) | Lr (mm) | Difference of thickness | Est. |
| E1 | 2 | 0.15 | 0.20 | 0.181 | 0.181 | Less than 1% | P |
| E2 | 3 | 0.10 | 0.20 | 0.458 | 0.115 | Less than 1% | P |
| E3 | 1.67 | 0.17 | 0.20 | 0.582 | 0.174 | Less than 1% | P |
| E4 | 1 | 0.14 | 0.20 | 0.236 | 0.002 | Less than 1% | P |
| E5 | 1.67 | 0.17 | 0.21 | 0.593 | 0.172 | Less than 1% | P |
| E6 | 1.67 | 0.17 | 0.21 | 0.593 | 0.172 | Less than 1% | P |
| E7 | 2.33 | 0.13 | 0.20 | 0.562 | 0.158 | Less than 1% | P |
| E8 | 4 | 0.08 | 0.20 | 0.457 | 0.097 | Less than 2% | P |
| E9 | 4 | 0.08 | 0.20 | 0.457 | 0.097 | Less than 2% | P |
| C1 | 3 | 0.10 | 0.20 | 0.485 | 0.115 | 0% | N |
| C2 | 1.67 | 0.17 | 0.20 | 0.582 | 0.174 | Less than 1% | N |

U: Feeding velocity
He: Thickness of coating layer 19
H1: Distance between web 15 and lip 14 of die 11
Db: Minimum thickness of bead
Lr: Length from lip to minimum thickness position
Est: Estimation In Table 3, the estimation was positive or good (describes as "P") when the coating layer is formed on the web without problem, and was negative (describes as "N") when the coating layer is formed on the web with problem.

Table 4 teaches the relation between the estimation in Table 3 and conditions of Db, Dg and Ds in Tables 1–3.

TABLE 4

| | Db (mm) | Dg (mm) | Ds (mm) | Est. |
|---|---|---|---|---|
| E1 | 0.181 | 0.6 | 3.228 | P |
| E2 | 0.485 | 0.6 | 2.610 | P |
| E3 | 0.582 | 0.6 | 4.032 | P |
| E4 | 0.236 | 1 | 1.474 | P |
| E5 | 0.593 | 0.6 | 4.032 | P |
| E6 | 0.593 | 0.6 | 4.032 | P |
| E7 | 0.562 | 0.6 | 3.692 | P |
| E8 | 0.457 | 0.5 | 3.407 | P |
| E9 | 0.457 | 0.5 | 2.718 | P |
| C1 | 0.485 | 5 | 2.610 | N |
| C2 | 0.582 | 0.1 | 4.032 | N |

When the condition $Db \leqq Dg \leqq Ds$ was satisfied, the estimation of the coating layer formed on the web is positive.

<Experiment 2>

In Experiment 2, the edge plate was attached to the die (Example 10), and the end block is changed (Example 11). However, a method of attachment of the edge plate to the die and that of change of the end block were not restricted in the following Examples 10 and 11.

Example 10

As shown in FIG. 18, the hardwood 26 was fit in the retraction formed on the top of the edge plate 12. The hardwood 26 and the edge plate 12 were formed of stainless and fluoride resin. According to the position of the hardwood 26, the length L3 from the outer surface was 10 mm, and the length L4 from the bottom of the edge plate 12 was 2 mm. Further, the width L5 of a top of the edge plate 12 was 50 mm. The screws were tightened to fix the edge plate on the die at a predetermined position, such that there may be no space between the edge plate and the die. Thereby the end of the edge plate 12 was moved only for 100 mm. Then the coating of the coating solution was carried out, the edge plate did not touch the web, and the coating solution was applied on the web, stably. This experiment was repeated three times, and the position of the edge plate is observed with a magnifier. The edge plate was attached at the almost same position on the die.

[Comparison 3]

The edge plate is formed of fluoride resin only. The screws were tightened to fix the edge plate on the die at a predetermined position, such that there may be no space between the edge plate and the die. Thereby the end of the edge plate moves for 500 μm forwards. Then the coating of the coating solution was carried out, the edge plate touched and damaged the web. Further, an forward end of the edge plate is broken.

[Experiment 11]

The edge plate used in Experiment 11 had the plate body 12*a* and the end block 12*b* as illustrated in FIG. 13B. The length L2 of the end block 12*b* was set to 40 mm. It took about 30 minutes to change the end block 12*b* to the same one. However, it takes about a month for changing the plate body 12*a* to the same one, as the other plate body 12*a* must be produced for changing.

Various changes and modifications are possible in the present invention and may be understood to be within the present invention.

What is claimed is:

1. A method for applying a coating solution on a web, comprising:

feeding said web continuously; and discharging said coating solution from a slot of a die, said discharged coating solution flowing on a slide surface of said die onto said web, with a bead formed between the slide surface and the web, a width of said coating solution being regulated by edge members which are provided in both sides on said slide surface, each said edge member having a regulation portion which is perpendicular to said slide surface and faces the other regulation portion, wherein a height Dg of said regulation portion satisfy a condition $Db \leqq Dg \leqq Ds$, Db being a minimum thickness of bead at vena contracta and Ds being an upper limit of a height of said regulation portion, which are represented as follows, $$Db=1.03\times h1-1.50\times he\times U^{-1/3}+12800\times he^2\times U$$

$$Ds(m)=\{3\times\eta\times q/(\rho\times g\times\sin\alpha)\}^{1/3}$$

wherein h1 is a distance between said web and a lip of said die in m, he is a thickness of said coating layer formed on said web as the coating solution flows onto the web, in m, U is a feeding velocity of said web in m/s, $\eta$ is an averaged viscosity of solution flowing on said slide surface at a shear rate in m·Pa·s, q is a total amount of said coating solution in a predetermined width in $m^3/(m\cdot sec)$, $\rho$ is an averaged density of said solution in $kg/m^3$, g is an acceleration of gravity in $m/sec^2$, and $\alpha$ is an angle of the slide surface with respect to horizontal, in °.

2. A method as claimed in claim 1, wherein said a front end portion of said edge member is nearer to said web than a front end of said slide surface, and a distance between said edge member and said web is more than 100 $\mu$m.

3. A method as claimed in claim 1, wherein said front end portion of said edge member is positioned on said slide surface, and a distance De between said front end portion of said edge member and said end of said slide surface satisfies a condition $De\leqq Lr$, and Lr is a length between said front end of said slide surface and a position of vena contracta of bead, and represented as follows;

$$Lr=0.270\times h1+1.00\times he-1.30\times he\times U^{-1/3}+5320\times U\times he^2.$$

4. A method as claimed in claim 3, wherein said edge member has a side inclination portion extending from an upper edge of said regulation portion, and said side inclination portion is inclined at between 45° and 75° to said slide surface.

5. A method as claimed in claim 3, wherein said edge member has a front inclination portion downstream on said slide surface, and said front inclination portion is inclined at between 35° and 60° to said slide surface.

6. A method as claimed in claim 3, wherein a distance between a front end of said slide surface and said web is set between 200 $\mu$m and 300 $\mu$m.

7. A method as claimed in claim 3, wherein a difference between a pressure $P_0$ of an upper surface and a pressure $P_b$ of a lower surface of said bead satisfies a condition, $300\ Pa\leqq P_0-P_b\leqq 1000\ Pa$.

8. A method as claimed in claim 7, wherein said web is previously warmed such that a temperature of a surface of said web becomes between 300° C. and 400° C.

* * * * *